US012631326B2

(12) United States Patent
D'Agostini et al.

(10) Patent No.: US 12,631,326 B2
(45) Date of Patent: May 19, 2026

(54) BURNER AND METHOD OF OPERATION

(71) Applicant: Air Products and Chemicals, Inc., Allentown, PA (US)

(72) Inventors: Mark Daniel D'Agostini, Allentown, PA (US); Anandkumar Makwana, Breinigsville, PA (US); Joshua E. Middaugh, Gilbertsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 347 days.

(21) Appl. No.: 18/233,419

(22) Filed: Aug. 14, 2023

(65) Prior Publication Data

US 2025/0060096 A1 Feb. 20, 2025

(51) Int. Cl.
*F23C 1/00* (2006.01)
*F23D 14/24* (2006.01)

(52) U.S. Cl.
CPC ..... *F23D 14/24* (2013.01); *F23D 2203/1012* (2013.01); *F23D 2204/00* (2013.01)

(58) Field of Classification Search
CPC ..... F23D 14/24; F23D 2203/1012; F23D 2204/00
USPC ..... 431/6
See application file for complete search history.

(56) References Cited

U.S. PATENT DOCUMENTS

| | | | | |
|---|---|---|---|---|
| 4,748,919 | A | 6/1988 | Campobenedetto et al. | |
| 5,308,239 | A | 5/1994 | Bazarian et al. | |
| 5,435,126 | A * | 7/1995 | Beaudoin | F23D 14/24 60/737 |
| 5,871,343 | A | 2/1999 | Baukal, Jr. et al. | |
| 6,019,595 | A | 2/2000 | Wulfert et al. | |
| 6,835,360 | B2 | 12/2004 | Warren | |
| 6,951,454 | B2 | 10/2005 | Sarv et al. | |
| 7,901,204 | B2 | 3/2011 | Stephens et al. | |
| 8,727,767 | B2 | 5/2014 | Watson et al. | |
| 8,899,969 | B2 | 12/2014 | Gard et al. | |
| 9,664,381 | B2 | 5/2017 | Gangoli et al. | |
| 2002/0197574 | A1 | 12/2002 | Jones et al. | |
| 2004/0146821 | A1 | 7/2004 | Joshi | |
| 2009/0113893 | A1* | 5/2009 | Li | F23R 3/14 60/737 |
| 2014/0069079 | A1 | 3/2014 | Koizumi et al. | |
| 2016/0169505 | A1* | 6/2016 | Ilchenko | F23C 7/06 431/169 |

(Continued)

FOREIGN PATENT DOCUMENTS

| | | |
|---|---|---|
| AU | 684296 | 12/1997 |
| CN | 111336515 | 6/2020 |

(Continued)

OTHER PUBLICATIONS

Charles E. Baukal, Jr., "Oxygen-enhanced combustion", CRC press, 2010.

*Primary Examiner* — Avinash A Savani
(74) *Attorney, Agent, or Firm* — Jason M. Ploeger

(57) ABSTRACT

The invention relates to particular burners, particularly to non-premixed or partially-premixed dual-fuel burners with flexibility to change the heat input from the two fuels. Accordingly, said burners may be used in applications that needs operation of a burner in both single-fuel, and/or duel-fuel mode depending on furnace operation needs. The invention further relates to furnaces including the burners and methods of operating the burners.

14 Claims, 15 Drawing Sheets

(56) References Cited

U.S. PATENT DOCUMENTS

| | | | | |
|---|---|---|---|---|
| 2016/0186662 | A1* | 6/2016 | Stewart | F23R 3/14<br>239/403 |
| 2018/0216828 | A1 | 8/2018 | Johansson et al. | |
| 2019/0056110 | A1* | 2/2019 | Stevens | F23R 3/286 |

FOREIGN PATENT DOCUMENTS

| | | |
|---|---|---|
| DE | 2530170 | 1/1977 |
| EP | 1850067 | 10/2007 |
| EP | 2014981 | 1/2009 |
| EP | 3967925 | 3/2022 |
| JP | S54141028 | 10/1979 |
| JP | 2016191533 | 11/2016 |
| WO | 2022053176 | 3/2022 |

* cited by examiner

[5]

Flame stabilization through anchoring at the step design

BURNER AND METHOD OF OPERATION

FIELD

The present invention relates to burners and particularly to industrial burners for gaseous fuels, and especially to the field of multi-fuel (two-fuel) burners.

BACKGROUND

In the prior art, many high-temperature melting or preheating furnaces are designed with an air-fuel burner in mind.

Due to increase in product demand or plant operational needs, manufacturers are looking to use burners, a means to provide energy to the process, that provide operational flexibility to the burners and in turn to the plants. Additionally for dual-fuel burners, there is a need of a burner that can be operated across a wide range of turndown, equivalence ratio, and/or flexibility to choose a fraction of heat supplied to the process from the two fuels. Furthermore, with increased focus on alternative fuels and availability of diverse gaseous fuels across geographical locations, there is a need for a burner that can operate for a wide range of fuels with minimal or no burner hardware change. It is particularly challenging to reliably start/ignite the burner at a low equivalence ratio (fuel lean start-ups), in particular in situations where one is unable to drop the air flow rate below a particular setpoint and one needs to flow at a minimum fuel flow rate.

There are several potential ways these challenges can be addressed.

First, fuel-flexible burners may be used, which can operate using any gaseous fuel such as natural gas ("NG"), liquefied petroleum gas ("LPG"), biogas, synthesis gas, hydrogen, ammonia or other gases, and meet the emissions and thermal performance criteria of the heating or melting furnace. Designing a fuel flexible gaseous fuel burner has several challenges depending on the burner type and design. Apart from wide variation in the combustion behavior of these fuels (well documented in combustion literature), e.g. the differences in heating value, reaction rates and flammability limits of the gaseous fuels creates a challenge when designing a burner.

Second, there generally is a challenge to further optimize the mixing of fuel and oxidants for partially-premixed burners.

Thirdly, there particularly is a challenge to reduce the length of the flame and to achieve a shorter flame that fits inside a compact/short reformer/furnace/combustion chamber.

Fourthly, a further general aim in the field of burners is to keep NOx emission low.

Fifth, there is a desire to operate the burner for a wide range of split of primary and secondary fuel.

It is therefore a first object of the present invention to provide an advantageous burner which alleviates or overcomes one or more of the above challenges.

Particular prior art designs of burners may be summarized as follows:

- U.S. Pat. No. 6,019,595 A e.g. discloses a burner with two combustion "media" (fuels), three coaxial tubes extending to different extents, core and intermediate tube ends sealed with openings (holes) for radial flow
- CN111336515 A e.g. discloses a burner having three concentric tubes with 3 streams: 2 fuel and one air, but e.g. mentions no tip design.

- US 2014/0069079 A1 e.g. discloses a gas turbine combustor with alternate gas and air holes, swirling flow path, two gas with one high (interior) and one low (exterior) BTU value
- U.S. Pat. No. 6,835,360 BB e.g. discloses a tube-in-tube reformer with a ring of tubes around a radiant mesh burner and a convective sleeve downstream of burner.

SUMMARY OF THE INVENTION

The present invention helps to solve above challenges by providing a new (non-premixed) multi-fuel (two fuel) burner.

In particular, the present invention provides burners having a unique swirl-inducing special tip, and e.g. split main oxidant for partial pre-mixing of the first fuel (e.g. NG/LPG stream) and swirl vanes for swirling main oxidant (e.g. air, oxygen, or combinations thereof) flow.

Burners of the present invention are regarded to allow for a more intimate mixing (e.g. from combined swirl and pre-mixing holes) leading to a shorter flame that fits inside a compact/short reformer/furnace/combustion chamber.

Specifically, the present invention relates to the subject-matter as defined in the claims.

Generally, the burners of the invention may e.g. be used in any application that needs high heating applications, specifically in applications like steam methane reforming, reheat furnaces in steel industry, or secondary melting furnaces.

In a general aspect, the invention provides a burner (1), comprising an ignition source (10), a primary fuel conduit (20) comprising a primary fuel outlet (22) having a multiplicity of primary fuel exit holes (23) for supply of a primary fuel into an ignition chamber (25), wherein the wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, a secondary fuel conduit (40) for supply of a secondary fuel, having a secondary fuel outlet (44) at its downstream end.

Preferably, at least in the downstream portion (5) of the burner (1), in which primary fuel outlet (22), ignition chamber (25), intermediate annular conduit (35) and secondary fuel outlet (44) are present, the primary fuel conduit (20) is surrounded by the main oxidant conduit (30) and the secondary fuel conduit (40).

Further provided by the present invention are, among others, a furnace including the burner of the present invention as well as methods for operating said burners.

Particular (further) advantages of the burners of the present invention are disclosed herein below.

BRIEF DESCRIPTION OF THE DRAWINGS

The present invention will hereinafter be described in conjunction with the appended figures wherein like reference numerals denote like elements.

DETAILED DESCRIPTION

Figure 1A:
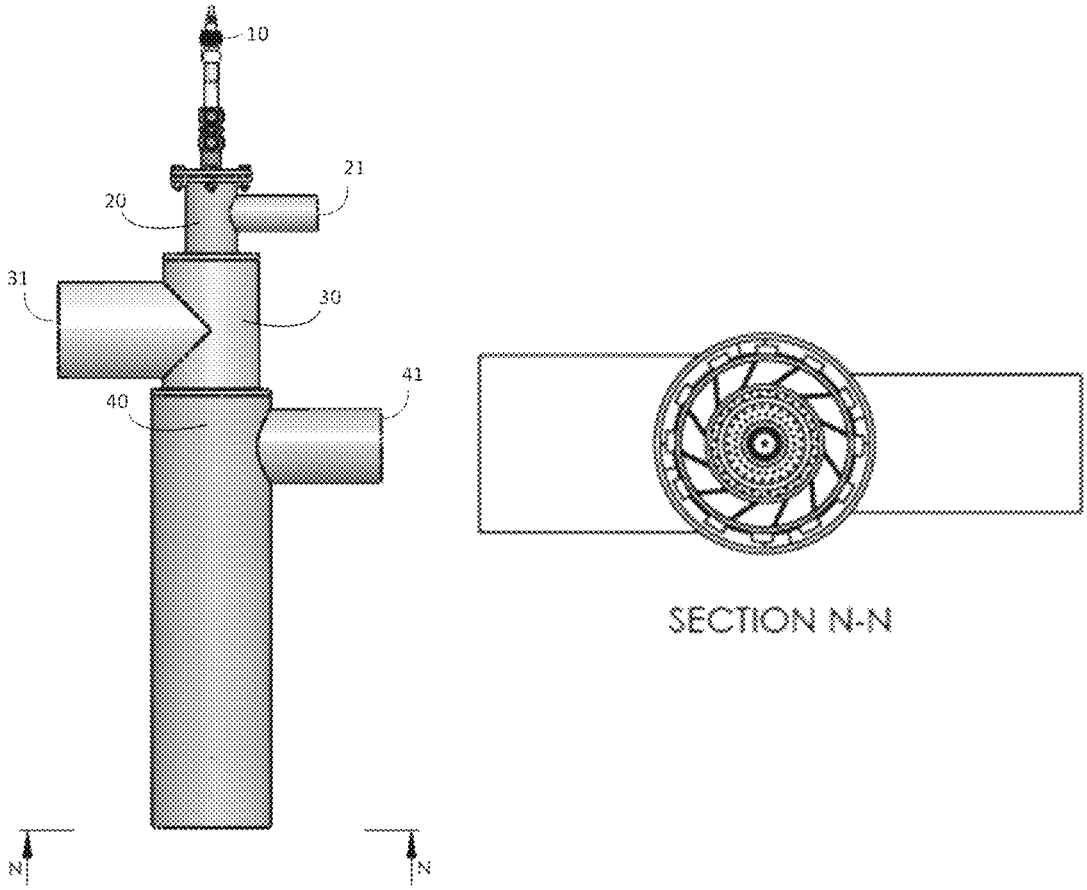
FIG. 1*a* is an exemplary side view of a downstream portion of an exemplary burner of the present invention including a cross section thereof at the downstream end. It particularly shows connectors of the respective conduits and a preferred arrangement having a central axis
Figure 1B:
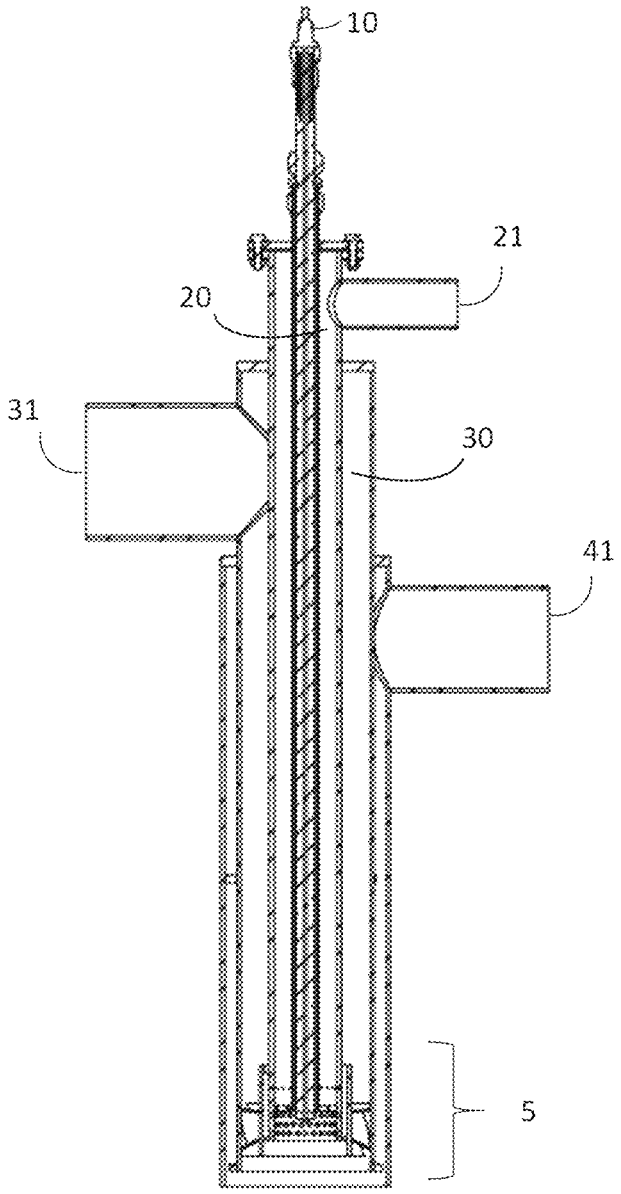
FIG. 1*b* is an exemplary side cross-sectional view of a downstream portion of an exemplary burner of the present invention. It particularly shows connectors of the respective conduits and a preferred arrangement having a central axis.
Figure 2A:
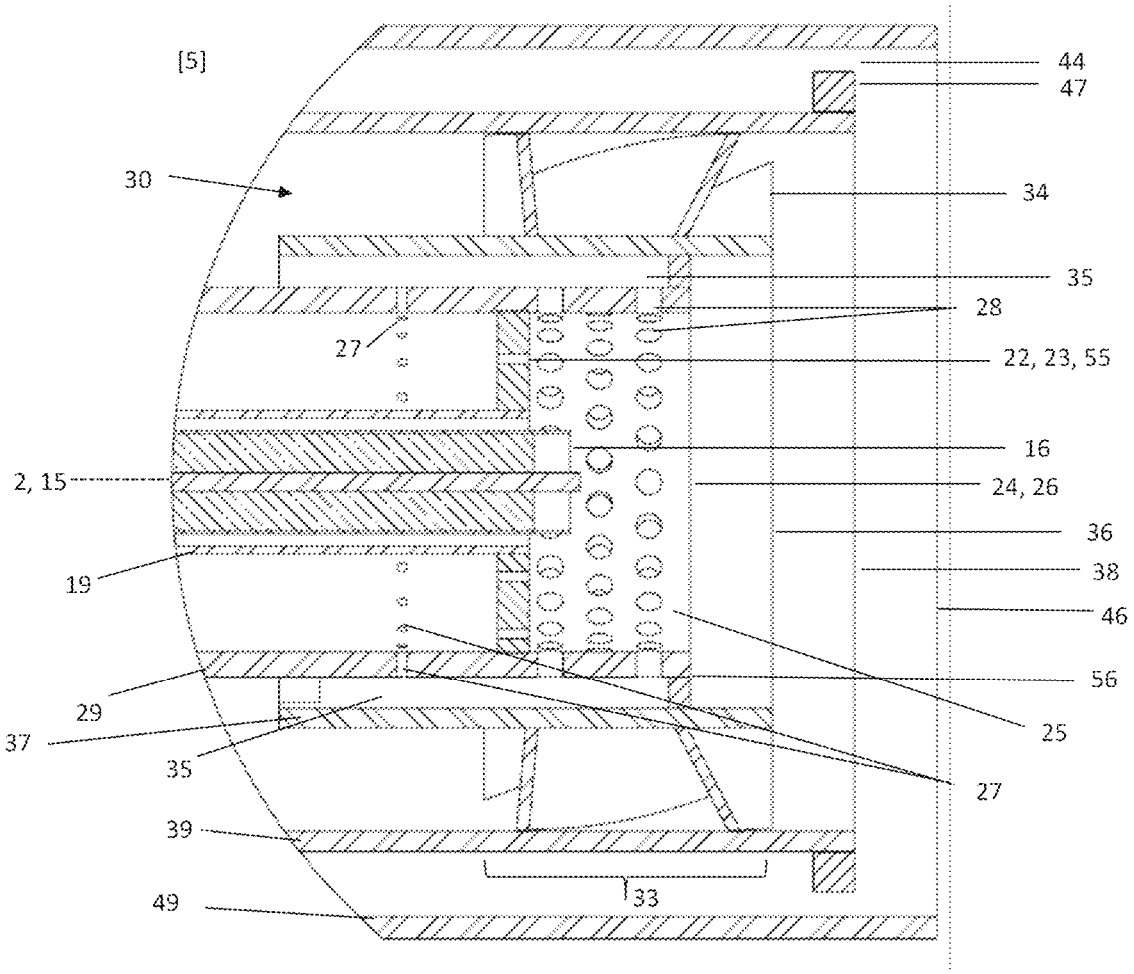
FIG. 2*a* is an exemplary side cross-sectional view of a downstream portion of a burner of the present invention e.g. indicating various (partly optional) components.
Figure 2B:
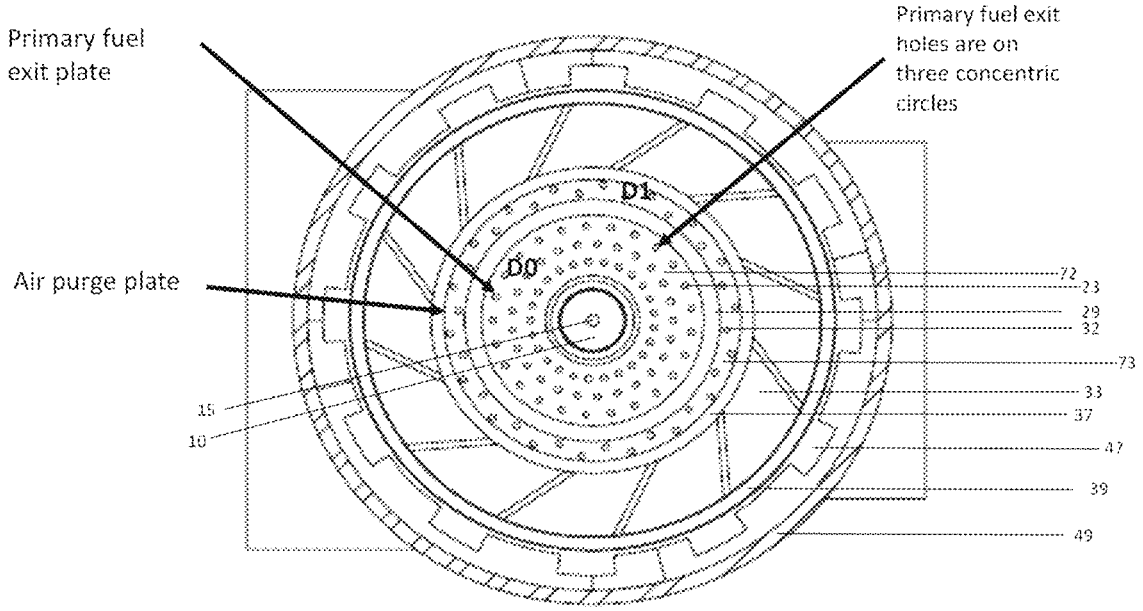
FIG. 2*b* is an exemplary cross-sectional view of a downstream portion of a burner of the present invention emphasizing various components and optional components.
Figure 3A:
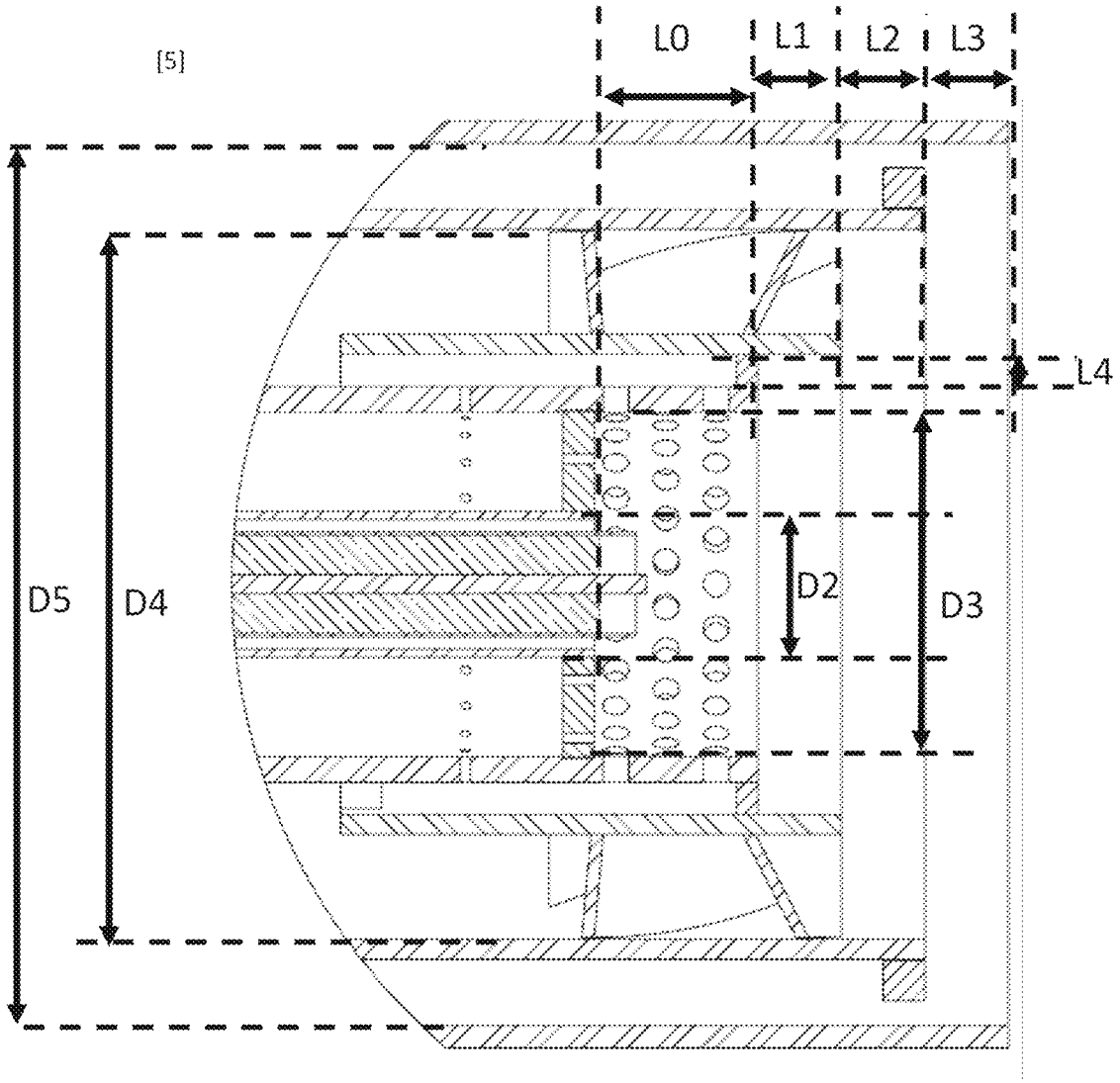
FIG. 3*a* is an exemplary side cross-sectional view of a downstream portion of a burner of the present invention emphasizing certain distances, diameters, and such like, such as dimensions of various conduits (or pipes, respectively), as well as certain distances between exit planes and outlets, respectively.
Figure 3B:
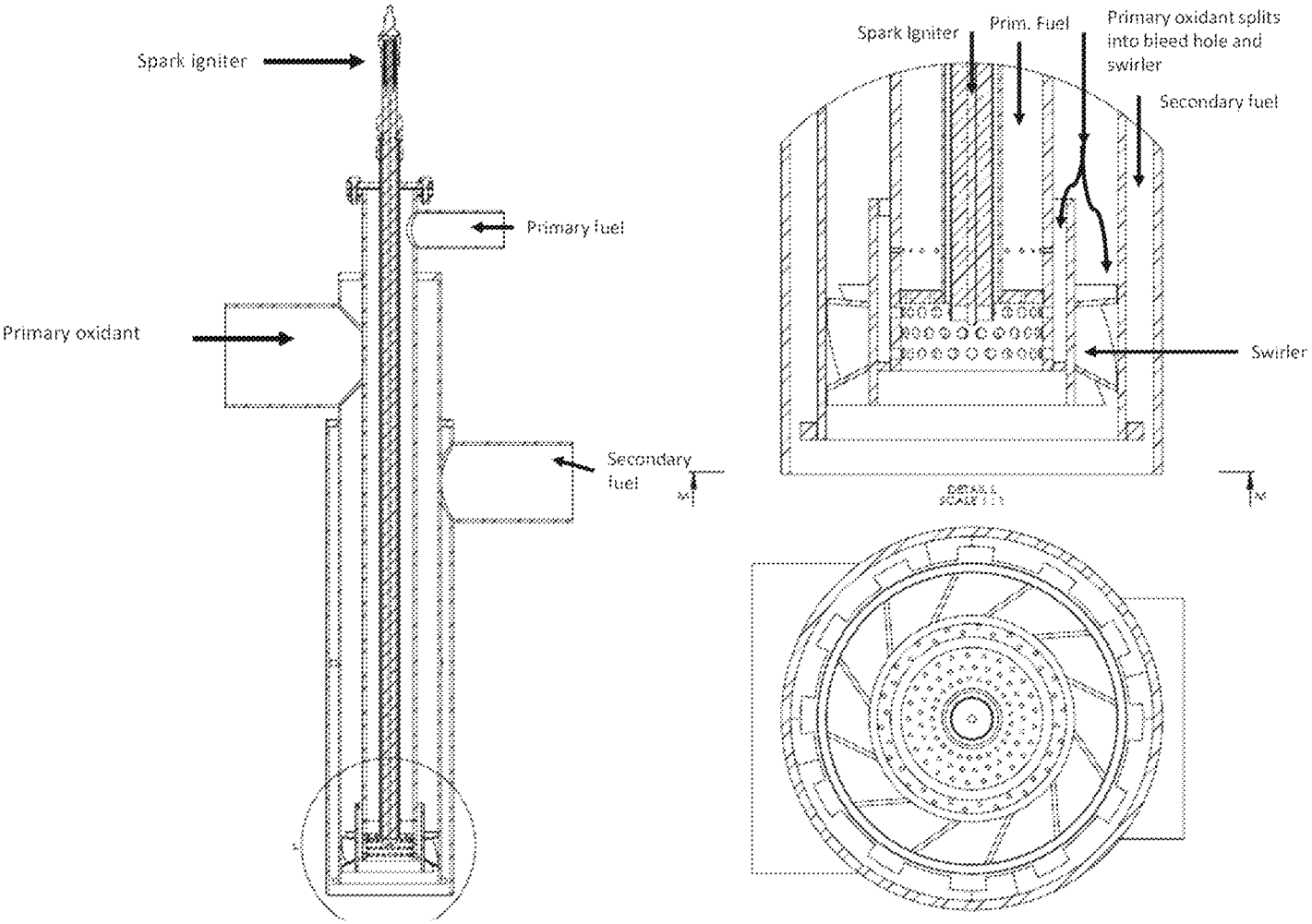
FIG. 3*b* provides exemplary sectional views of a (downstream portion of a) burner of the present invention emphasizing the flow of certain components.
Figure 4:
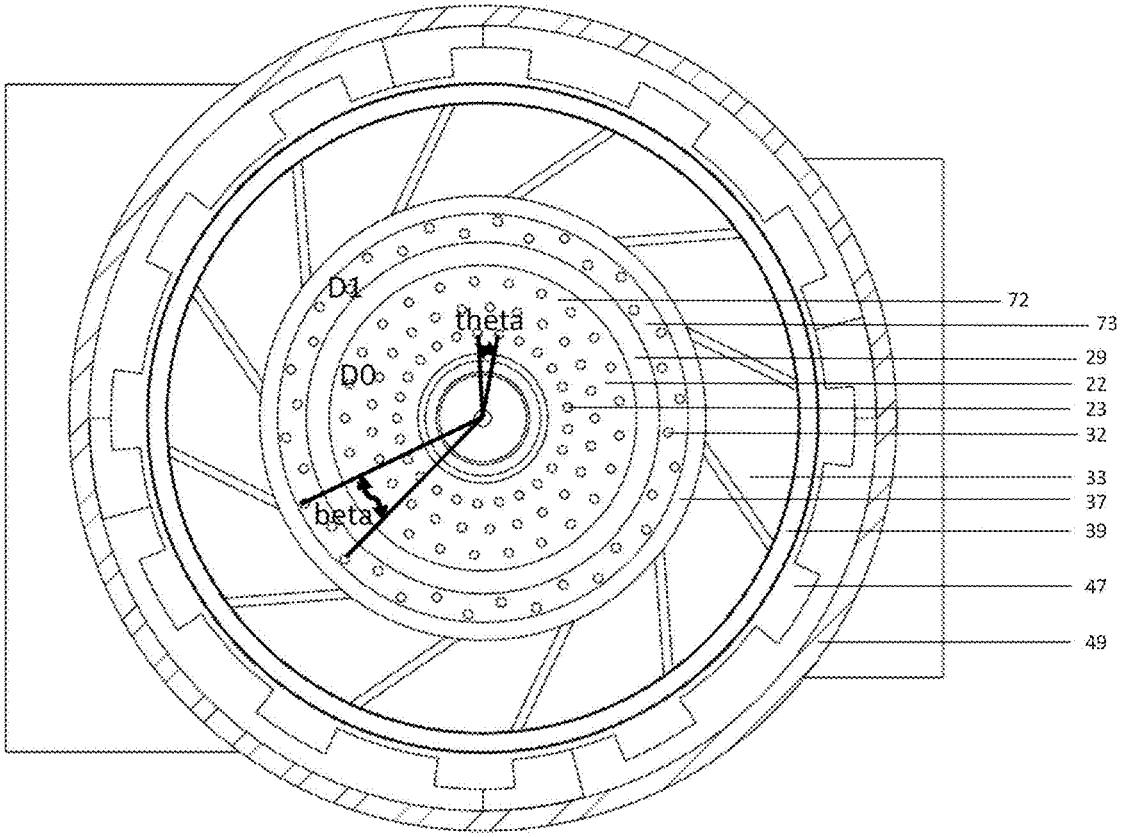
FIG. 4 is an exemplary cross-sectional view of a downstream portion of a burner of the present invention emphasizing certain angles and distances, such as D0 as a diameter of primary fuel exit holes and D1 as a diameter of purge holes. It further shows how consecutive holes in different rows of holes may be staggered by half the included angle between the two consecutive holes in one row.
Figure 5:
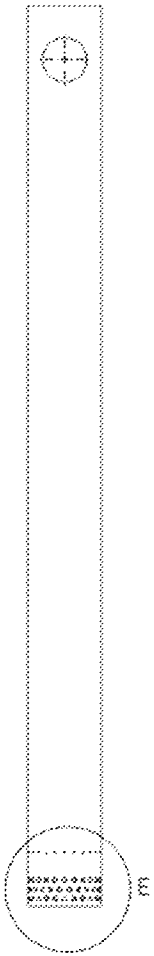
FIG. 5 includes schematic views of a primary fuel conduit in accordance with an embodiment of the present invention emphasizing a facultative arrangement of bleed holes (of diameter P1) and indicating optional air premixing holes). It further further indicates angle alpha, i.e. the angle between the center of two consecutive holes measured at the center of the conduit.
Figure 5:
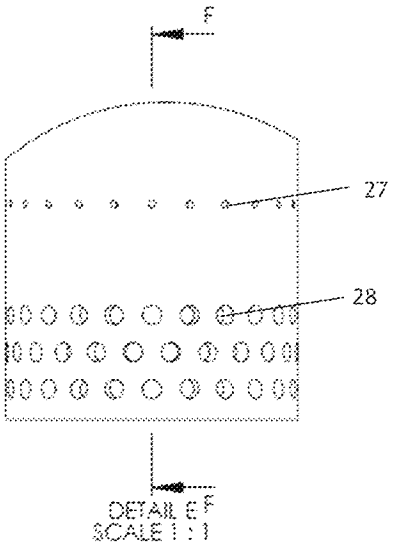
Figure 5:
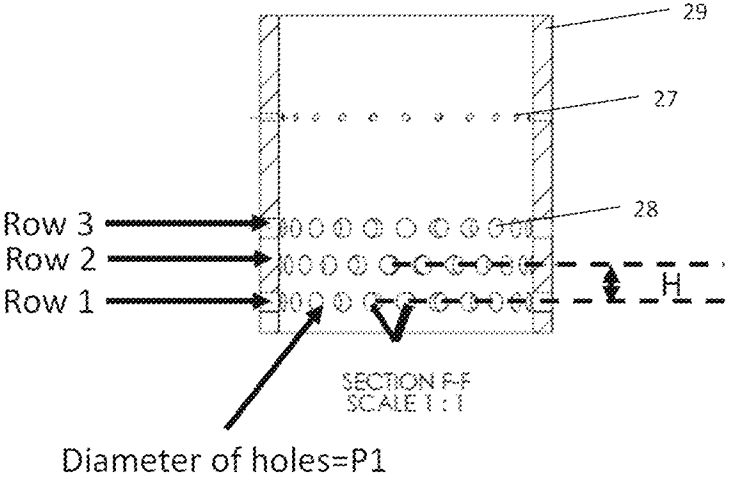

The present invention generally provides burners and further subject-matter as defined in the claims.

The burner of the present invention overcomes above-described prior art challenges in various ways as already depicted above.

For example, this burner design enables rapid and thorough mixing of a portion of the air-fuel mixture at the point of ignition. This is enabled via air entrainment in the fuel jet through a unique burner cup tip (ignition chamber) design, thereby allowing reducing peak temperatures relative to common characteristics of non-premixed burners. The lower peak temperatures help to reduce thermal NOx formation as compared to conventional air-fuel non-premixed combustion.

Besides, the burner may be operated in a cold furnace (that is <400 F average temp during start-up sequence of the burner) without the need of oxygen assistance or a continuous ignition source. The burner may further be stably operated in a fuel lean, low flame temperature mode. The burner produces a stable flame (without any lift-off) over a very broad 30:1 turndown range, even with an equivalence ratio as low as 0.25. These features enable pre-heating of the process furnace at a controlled rate to allow the process to initiate and come to a steady-state condition within a time-frame dictated by process requirements.

This burner allows to start/ignite the burner at low equivalence ratio (fuel lean start-ups), in particular in situations where it is not possible to reduce the air flow rate below a particular setpoint while start-up fuel flow is simultaneously minimized for safety reasons. The equivalence ratio is defined as the ratio of the actual fuel/air molar ratio to the stoichiometric fuel/air molar ratio.

The burner allows to operate the furnace over a wide range of the ratio of primary to secondary fuel total heating value (i.e. firing rate ratio).

Moreover, the oxidizer back pressure (e.g. air) in burners of the invention may be such that it is not required to have any external secondary compression device for these streams. This feature helps to reduce the burner operating costs and any maintenance involved with such activities.

In particular, in a first aspect herein, there is provided a burner (1), comprising an ignition source (10); a primary fuel conduit (20) comprising a primary fuel outlet (22) having a multiplicity of primary fuel exit holes (23) for supply of a primary fuel into an ignition chamber (25), wherein the wall surrounding the ignition chamber (25) comprises a plurality of bleed holes (28); a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel; a secondary fuel conduit (40) for supply of a secondary fuel, having a secondary fuel outlet (44) at its downstream end; wherein at least in the downstream portion (5) of the burner (1), in which primary fuel outlet (22), ignition chamber (25), intermediate annular conduit (35) and secondary fuel outlet (44) are present, the primary fuel conduit (20) is surrounded by the main oxidant conduit (30) and the secondary fuel conduit (40).

As used herein, a "downstream portion of the burner" in which certain outlets "are present" refers to a downstream portion that comprises all of said outlets. Moreover, the said portion further comprises the swirler section and/or bleed holes.

The term "downstream portion" is used herein exchangeably herein with the term "downstream section".

In preferred embodiments herein, at least in the downstream portion (5) of the burner (1), in which primary fuel outlet (22), ignition chamber (25), intermediate annular conduit (35), and secondary fuel outlet (44) are present, the main oxidant conduit (30) and the secondary fuel conduit (40) are arranged essentially concentrically around the primary fuel conduit (20)

In particular embodiments of the present invention, where one or more given conduits are arranged (concentrically) around one or more given other conduits, said conduit(s) are arranged around another in a section corresponding to at least 20%, preferably in at least 30%, particularly in at least 40%, especially in at least 50%, and in some embodiments in at least 75%, of the total length of the burner, wherein the said section includes the primary fuel outlet, main oxidant outlet, secondary fuel outlet and auxiliary oxidant outlet. Moreover, in case that a swirler section and/or a bleed hole annulus is/are additionally present, the said portion preferably further includes the swirler section and/or bleed hole annulus.

Herein, the "total length" of the burner of the invention is determined by establishing the distance between the furthest upstream end of all conduits and the furthest downstream end of all conduits.

In a further preferred embodiment the primary fuel conduit, the main oxidant conduit and the secondary fuel conduit are arranged concentrically around the central ignition source along their full length.

In preferred embodiments of the invention, where a given conduit is arranged concentrically around another conduit, this results in the formation of a respective annulus.

Consequently, in preferred embodiments herein, the burner is configured in such a way that the one or more fuels or oxidants flow through at least one annulus. In the present invention, such annuli may further be characterized by containing further elements of the respective conduits (such as exit holes, bleed holes, a swirler section and suchlike) as defined elsewhere herein.

Likewise, in preferred embodiments herein, the burner is characterized in that one or more outlets of the conduits are configured as annular rings. In the present invention, such annular rings may be characterized by containing further elements (such as exit holes, bleed holes, a swirler section and suchlike) as defined elsewhere herein.

Generally, in the present invention, a certain conduit (is described as being "surrounded" by a certain other conduit (or several other conduits, respectively) if said conduit has a smaller diameter than said other conduit(s) and is arranged inside said other conduit(s).

However, for being "surrounded" by another conduit, a given conduit does not need to be entirely surrounded by the other, but may also extend further downstream and/or upstream from the other. Respective definitions apply herein, where a given element is said to be "arranged around" another element.

In preferred embodiments, a conduit that is described to be surrounded by (an)other conduit(s) shares its longitudinal axis with the other(s).

In preferred embodiments, the ignition chamber (25) is extending from the primary fuel conduit exit plane (55) to the intermediate annular conduit exit plane (56).

In certain preferred embodiments, the ignition chamber (25) is characterized by at least two (preferably by two or three) steps in its wall, wherein each step comprises a rows of bleed holes (28).

In certain preferred embodiments, the ignition chamber (25) comprises a section having an outer diameter that is smaller than or equal to the inner diameter of the primary fuel conduit (20).

In certain preferred embodiments, the ignition chamber (25) further comprises a section having an inner diameter that is greater than the outer diameter of the primary fuel conduit (20), but having an outer diameter that is smaller than the inner diameter of the intermediate annular conduit (35).

More specifically, in one set of particularly embodiments, the burner is characterized in that the ignition chamber (25) is extending from the primary fuel outlet (22) to the intermediate annular conduit exit plane (56), wherein the wall surrounding the ignition chamber (25) comprises at least two (preferably two or three) steps of annular conduits with increasing diameter, each of which comprises a plurality of bleed holes (28).

In another set of particular embodiments, the burner is characterized in that the ignition chamber (25) is extending from the primary fuel outlet (22) to the intermediate annular conduit exit plane (56), wherein the wall surrounding the ignition chamber (25) comprises two sections, wherein i) the first section is extending from the primary fuel outlet (22) to the primary fuel conduit end plane (24), wherein the primary fuel conduit wall (29) surrounding the section comprises a plurality of bleed holes (28), and ii) the second section has an inner diameter greater than the outer diameter of the primary fuel conduit (20), but the second section has an outer diameter smaller than the inner diameter of the intermediate annular conduit (35), and comprises a further plurality of bleed holes (28), and wherein iii) the burner optionally further comprises an air purge plate (73) with purge holes (32) that extends between the first section's outer diameter and the inner diameter of the second section, and iv) the burner optionally further comprises two mechanical mixer plates (74) each located downstream of and adjacent to the said two sections, and v) the burner optionally further comprises a purge plate (73) with purge holes (32) present between the outer diameter of the second section and inner diameter of the intermediate annular conduit (35).

Preferably, the mechanical mixer plates (74) have a disk type structure that breaks the fuel flow coming out of fuel exit holes (23). In particular, the first mechanical mixer plate has a disk type structure (mechanical mixer 1) that breaks the fuel flow coming out of the 'outer series' of fuel exit holes (23). The disk breaks these fuel jets and help with quick mixing of fuel and air inside the ignition chamber.

Preferably, the purge plate (73) is a disc that comprises purge holes (32). More preferably, the plate/disk is present between the fuel conduit wall (29) and the intermediate conduit wall present inside the conduit (35).

In a further set of particular embodiments, the burner is characterized in that wherein the ignition chamber (25) is extending from the primary fuel outlet (22) to the intermediate annular conduit exit plane (56), wherein the wall surrounding the ignition chamber (25) comprises two sections, wherein i) the first section has an outer diameter smaller than the inner diameter of the primary fuel conduit (20) and comprises a plurality of bleed holes (28), wherein the primary fuel conduit wall (29) surrounding the first section comprises a plurality of bleed holes (28), and wherein the first section further comprises means allowing the main oxidant to additionally enter the ignition chamber (25) in flow direction in between two rings of primary fuel exit holes, ii) the second section has an inner diameter greater than the outer diameter of the primary fuel conduit (20), but the second section has an outer diameter smaller than the inner diameter of the intermediate annular conduit (35), and comprises a further plurality of bleed holes (28), and wherein) the burner optionally further comprises iii) a purge plate (73) with purge holes (32) present between the first section's outer diameter and inner diameter of the second section, and iv) a purge plate (73) with purge holes (32) present between the outer diameter of the second section and inner diameter of the intermediate annular conduit (35).

Preferably herein, the ignition source (10) terminates in the ignition chamber (25).

In certain embodiments, the ignition source (10) is a central ignition source having a central axis (15) and a conduit end plane (16).

In preferred embodiments herein, the main axis (2) of the burner (1) coincides with the central axis (15) of the ignition source (10).

Preferably, at least in said downstream portion (5) of the burner (1), the central ignition source (10) is surrounded by the primary fuel conduit (20), the main oxidant conduit (30) and the secondary fuel conduit (40).

In certain embodiments, the main axis (2) of the burner (1) coincides with the central axis (15) of the ignition source (10).

Further as to the ignition source (10), same may be designated herein as "pipe 1".

The (central) ignition source may also be referred to herein simply as "igniter".

Herein, the outer diameter of the ignition source (10) may be defined as D2.

Accordingly, the central ignition source wall (19) may have an outer diameter D2.

Furthermore, the central ignition source is preferably arranged in the center of the burner, preferably along its full length, particularly wherein the remaining conduits of the burner are arranged concentrically around the central ignition source.

Further as to the primary fuel conduit (20), same may be designated herein as "pipe 2", which is a gaseous fuel pipe.

Herein, the inner diameter of the primary fuel conduit (20) may be defined as D3.

Accordingly, the primary fuel conduit wall (29) may have an inner diameter D3.

In certain embodiments, the primary fuel conduit end plane (24) corresponds to the ignition chamber end plane (26).

The primary fuel conduit (20) further comprises a primary fuel outlet (22). In certain embodiments, said primary fuel outlet (22) is configured as a plate (72) comprising primary fuel exit holes (23), particularly as an fuel plate (72) comprising primary fuel exit holes (23).

The primary fuel conduit (20) may further comprise a particular primary fuel connector (21).

Herein, the distance between the primary fuel outlet (22) and the primary fuel conduit end plane (24) and/or ignition chamber end plane (26) may be defined as L0. Accordingly, in certain embodiments, the primary fuel outlet (22) is recessed in upstream direction from the primary fuel conduit end plane (24) by a distance L0. Preferably, the primary fuel conduit end plane (24) corresponds to the ignition chamber end plane (26).

In the burners herein, the primary fuel conduit (20), more specifically the primary fuel outlet (22), further comprises primary fuel exit holes (23). Accordingly, the primary fuel outlet (22) may also be designated herein a "fuel distribution nozzle". Said outlet/nozzle maybe described as having a multiplicity of holes introducing the primary-fuel into an ignition chamber.

Herein, the diameter of the primary fuel exit holes (23) may be defined as D0. Preferably, D0/D2 is between 0.04 and 0.5

In particular embodiments, the primary fuel exit holes (23) are located on concentric circles around the center of the primary fuel exit plate (72). Preferably the total number of concentric circles are in the range of 2-7, more preferably the total number of concentric circles is between 2-5. Preferably, the holes are of circular shape. The holes can be any other shape such as stars, triangles, double-stars, rectangle, etc.

Without intending to be bound by theory, such size significantly contributes to the ability to quickly mix the fuel with surrounding air.

Herein, the circumferential angle defined by the main axis (2) of the burner and the centers of two adjacent primary fuel exit holes (23) may be defined as angle theta.

In the burners herein, the primary fuel conduit (20) further comprises bleed holes (28).

Herein, the inner diameter of the bleed holes (28) may be defined as P1. Preferably, P1/D2 is between 0.05 and 0.4.

In particular embodiments, the bleed holes (28) are arranged in rows around the primary fuel conduit. Preferably there will be no more than 5 rows of bleed holes; more preferably no more than 3 rows of bleed holes. Preferably, the holes are of circular shape. The holes can be any other shape such as stars, triangle, double-stars, rectangle, etc.

Herein the axial distance between two rows of bleed holes (28) measured between their centers may be defined as H.

Herein, the circumferential angle defined by the main axis (2) of the burner and the centers of two adjacent bleed holes (28) may be defined as angle alpha.

In particular embodiments herein, the primary fuel conduit (20) further comprises air premixing holes (27), upstream of the primary fuel outlet (22).

Herein, the diameter of the air premixing holes (27) may be defined as P0. Preferably, P0/D2 is between 0.02 and 0.2.

In particular embodiments, the air premixing holes (27) are arranged in rows around the primary fuel conduit. Preferably there will no more than 5 rows of premixing holes. More preferably there will be no more than 3 rows of premixing holes. Preferably, the holes are of circular shape. The holes can be any other shape such as stars, triangles, double-stars, rectangles, etc.

Herein, the distance between the primary fuel conduit wall (29) and the intermediate annular conduit wall (37) may be defined as L4.

Further as to the main oxidant conduit (30), same may be designated herein as "pipe 3", particularly as an air pipe.

Herein, the inner diameter of the main oxidant conduit (30) may be defined as D4.

Accordingly, the main oxidant conduit wall (39) may have an inner diameter D4.

Herein, the distance between the intermediate annular conduit end plane (36) and the main oxidant conduit end plane (38) may be defined as L2. Accordingly, in certain embodiments, the intermediate annular conduit end plane (36) is recessed in upstream direction from the main oxidant conduit end plane (38) by a distance L2.

In the burners herein, the main oxidant conduit (30) further comprises an intermediate annular conduit (35).

In the present invention, the intermediate annular conduit (35) is configured to allow splitting of the main oxidant into two portions, such that a first portion is introduced into the ignition chamber (25) via a plurality of bleed holes (28) as defined above.

The first portion is preferably about 20% of the total volumetric flow. In particular embodiments, the first portion is in the range of 2%-40%, preferably the range is 10% to 25%.

In preferred embodiments herein, the first portion of the main oxidant enters into the ignition chamber at a right angle to the primary fuel outlet. (via the peripheral wall of the chamber).

Accordingly, in preferred embodiments herein, the first portion of the main oxidant enters into the ignition chamber in a direction that is perpendicular to the flow direction of the primary fuel.

Without intending to be bound by theory, this serves to vigorously mix the fuel and "ignition" air such that peak flame temperatures are reduced compared with typical diffusion flames. This is regarded important for minimization of flame-generated NOx emissions. Moreover, the method of air introduction also keeps the peripheral wall cooled by protecting it from direct contact with the flame.

Herein, the distance between the primary fuel conduit end plane (24) and the intermediate annular conduit end plane (36) may be defined as L1. Accordingly, in certain embodiments, the primary fuel conduit end plane (24) is recessed in upstream direction from the intermediate annular conduit end plane (36) by a distance L1.

In preferred embodiments of the present invention the burners are characterized in that the main oxidant conduit (30) further comprises a swirler section (33).

Accordingly, the intermediate annular conduit (35) is preferably configured to allow splitting of the main oxidant into two portions, wherein a second portion is introduced into a swirler section (33).

In particular, in preferred embodiments herein, the annular conduit (35) is configured to allow splitting of the main oxidant into two portions, such that a first portion is introduced into the ignition chamber (25) via the plurality of bleed holes (28) to mix with the primary fuel, and a second portion is introduced into a swirler section (33), which further comprises the main oxidant conduit.

Without intending to be bound by theory, the second portion of air introduced into the swirler section induces a strong tangential flow field in the combustion chamber that acts to increase the rate of mixing among the oxidant and fuel, while also creating a compact flame and one that does not contain appreciable soot.

Again without intending to be bound by theory use of a swirler to swirl the air is well-known in the field of combustion. The primary function of the swirl is to provide a tangential flow to e.g. the air exiting pipe 3 and create a recirculation zone at the center that brings in hot combustion gases back towards the burner exit plane thereby providing a continuous source of ignition to the fresh reactants. The upper and lower bound of the swirl angle is determined by the length of the furnace, and burner firing rate.

Preferably, the swirl angle is from 5 to 60 degrees, preferably from 30 to 45 degrees.

As used herein, a "swirl angle" is defined to be the angle between a plane that is nominally tangent to the outlet of the swirler blades and the plane parallel to the main axis of the burner.

Preferably herein, the swirl number (which is defined herein as the ratio of the axial flux of the tangential momentum and the axial flux of the axial momentum) is in the range from 0.1 to 1.5.

In certain embodiments, the main oxidant conduit (30) further comprises purge holes (32) located on the air purge plate (73), particularly in flow direction parallel to the main axis (2) of the burner.

Herein, the diameter of the purge holes (32) may be defined as D1. Preferably, D1/D2 is between 0.04 and 0.5

In particular embodiments, the purge holes (32) are arranged in a circular way on different concentric diameters as 1-7 row, preferably 1-3 concentric diameters of holes. Preferably, the holes are of circular shape. The holes can be any other shape such as stars, triangle, double-stars, rectangle, etc.

Herein, the circumferential angle defined by the main axis (2) of the burner and the centers of two adjacent purge holes (32) may be defined as angle beta.

The main oxidant conduit (30) may further comprise a particular main oxidant connector (31).

Further as to the secondary fuel conduit (40), same may be designated herein as "pipe 4", which is a gaseous fuel pipe.

Herein, the inner diameter of the secondary fuel conduit (40) may be defined as D5.

Accordingly, the secondary fuel conduit wall (49) may have an inner diameter D5.

In certain embodiments, the burner (1) further comprises a turbulence generator (47) in the secondary fuel conduit (40).

A turbulence generator may also be referred to herein as means for generating turbulences or turbulence generator means, respectively. Same may comprise one or more turbulence generator disk(s) or turbulence generator plates, respectively. Preferably, said turbulence generator means are arranged at an additional wall of the secondary fuel conduit, which is positioned next to the wall of the main oxidant conduit.

In certain embodiments, the burner further comprises swirl vanes in the secondary fuel conduit.

Herein, wherein the distance between the main oxidant conduit end plane (38) and the secondary fuel conduit end plane (46) may be defined as L3. Accordingly, in certain embodiments, main oxidant conduit end plane (38) is recessed in upstream direction from the secondary fuel conduit end plane (46) by a distance L3.

The burners of the present invention are designed to operate using any gaseous fuels like natural gas (NG), hydrogen (H2), LPG, biogas, synthesis gas, hydrogen, ammonia or other gases Hence, in accordance with the present invention, the primary fuel used in the burner is any gaseous fuel. In preferred embodiments, it is selected from the group consisting of NG, H2, and LPG.

In accordance with the present invention, the secondary fuel is any gaseous fuel. In preferred embodiments, the secondary fuel is tailgas. In preferred embodiments, the secondary fuel is selected from the group consisting of PSA waste gas, syngas, and a H2/CO/CO2/CH4 mixture).

Generally herein, the specific nature of the fuels and oxidants to be used with the burner of the present invention is not particularly limited. Moreover, in some embodiments, the material flowing through a particular conduit (e.g., fuel or oxidant) may be replaced with a material that is either the same or different (e.g., oxidant or fuel) from what is disclosed above. For example, a secondary oxidant may be used in lieu of the secondary fuel in the burner (1). In this particular embodiment, a fuel flows through the primary fuel conduit (20) of the burner (1) while an oxidant flows through the main oxidant conduit (30), and the secondary fuel conduit (40). Alternatively, in some embodiments, a secondary fuel can be used in lieu of the main oxidant. In this embodiment, a fuel flows through the primary fuel conduit (20) and the main oxidant conduit (30) of the burner (1) while an oxidant or fuel flows through the secondary fuel conduits (40). In other words, any combination of fuel or oxidant can flow through the primary fuel conduit (20), the main oxidant conduit (30), and the secondary fuel conduit (40) of the burner (1).

As used herein, an "outlet plane" of a given conduit designates a plane defined in direction perpendicular to the main axis of the conduit at a downstream location where the fuel or oxidant respectively is no longer restricted by two walls.

As used herein, a "conduit end plane" of a given conduit designates a plane defined in direction perpendicular to the main axis of the conduit at the downstream end of the conduit.

In preferred embodiments herein, D3/D2 is from 1.5 to 4.5, in particular from 2.0 to 3.0.

In preferred embodiments herein, D4/D2 is from 3.0 to 9.0, in particular from 3.5 to 5.5.

In preferred embodiments herein, D5/D2 is from 5.0 to 11.0, in particular from 5.5 to 7.0.

In preferred embodiments herein, L1/L4 is from 0.5 to 2.5, in particular from 1.0 to 2.0.

In preferred embodiments herein, L0/D3 is from 0.25 to 1.0, in particular from 0.4 to 0.6.

In preferred embodiments herein, (L1+L2)/D3 is from 0.25 to 1.0, in particular from 0.4 to 0.6.

In preferred embodiments herein, L3/D4 is from 0.05 to 0.25, in particular from 0.1 to 0.2.

In preferred embodiments herein, H/P1 is from 1.25 to 2.5.

In preferred embodiments herein, angle alpha is from 3 to 30, such as from 10 to 20 degrees. The ratio of area of all bleed holes in one row to the surface area of cylinder of height, P1 and inner diameter, D2 is between 10% and 55%

Without intending to be bound by theory, a lower range limit of angle alpha helps to separate the holes such that they are not too close to disturb the intermixing of fuel and air—and a higher range limit of angle alpha prevents the holes from being too far apart and ensures there is enough fluid communication between adjacent jets to enhance mixing and ignition of fuel-air inside the ignition chamber.

Each row may be symmetrically staggered to provide three dimensional mixing effects. This mixing is critical to provide a reliable ignition of the burner at lean equivalence ratio of as small as 0.25.

In preferred embodiments herein, angle beta is from 5 to 40 degrees.

In preferred embodiments, the air purge plate (73) has a porosity (defined by the total open area on the plate that allows the air to flow divided by cross-section area of the plate) in the range of 2% to 15%.

Without intending to be bound by theory, a lower range of angle beta helps to separate the holes such that they are not too close to create air rich regions and a higher range of angle beta prevents the holes from being too far, ensures there is enough fluid communication between adjacent jets to mutually provide chemically active flame radicals that support ignition and thereby enhance flame stability. enough air for fuel-air mixing and create low velocity regions and recirculation zones to provide flame anchoring zone. This flame anchoring location is critical for holding the flame without blow-off, for example under extreme circumstances such as when the primary fuel is reduced to 10% of maximum firing rating of the burner and secondary fuel is cut-off/shut-down.

In some embodiments, the burner comprises different rows of holes and consecutive holes in different rows of holes are staggered by half the included angle between the two consecutive holes in one row.

In preferred embodiments herein, angle theta is from 10 to 40 degrees.

In preferred embodiments, the primary fuel exit plate (72) has a porosity (defined by the total open area on the plate that allows the fuel to flow divided by cross-section area of the plate) in the range of 2% to 25%.

Without intending to be bound by theory, a lower range limit of angle theta helps to separate the holes such that they are not too close to prevent air entrainment in the fuel jet as the two fuel jets get too close—and a higher range of angle theta prevents the holes from being too far and ensures there is enough coupling between two jet development to provide stable flame overall a wide range od turndown and equivalence ratio.

In some embodiments, the burner comprises different rows of holes and consecutive holes in different rows of holes are staggered by half the included angle between the two consecutive holes in one row.

In preferred embodiments, the burner (1) is configured in such a way that the velocity of the primary fuel at the exit of the primary fuel exit holes (23) is between 30 ft/s and 500 ft/s, particularly between 40 ft/s and 400 ft/s.

Without intending to be bound by theory, the velocity of primary fuel is determined to significantly contribute to the ability quickly mix the fuel with surrounding air. This velocity range provides a stable flame without any lift-off.

In preferred embodiments, the burner (1) is configured in such a way that the velocity of the main oxidant at the exit of the oxidizer pipe (34) is between 5 ft/s and 300 ft/s, particularly between 10 ft/s and 200 ft/s.

Without intending to be bound by theory, the maximum attainable main oxidant (preferably air) velocity is typically determined by the available pressure from the air blower. The present inventors found that these velocities along with appropriate swirl angle provides sufficient mixing of the air with the two fuels and maintains a stable flame over a wide range of burner operations even in a cold furnace.

In preferred embodiments, the burner (1) is configured in such a way that the velocity of the secondary fuel is between 20 ft/s and 200 ft/s, particularly between 40 ft/s and 120 ft/s.

Without intending to be bound by theory, the velocity of the secondary fuel is determined such that it provides sufficient mixing with the swirling air thereby enabling a stable flame. Secondary fuel velocity that is below the low velocity limit can result in unreacted fuel collecting near the furnace wall. This fuel can subsequently combust there causing over-heating of the reformer top wall.

In preferred embodiments, the burner of the invention is operated in such a way that i) during start-up, about 100% of the total thermal power (defined as the summation of the product of heating value (higher or lower) and flow rate of each fuel) of the burner is provided by the primary fuel; and/or ii) during normal operation, about 5 to 70%, preferably 45 to 65% of the total thermal power of the burner is provided by the primary fuel, and the respective rest is provided by the secondary fuel.

The respective rests are preferably provided by the secondary fuel.

In preferred embodiments, the burner is configured in such a way that i) the volumetric flow rate of the ignition chamber oxidant is about 5 to 25% of the total main oxidant flow rate; and/or ii) the volumetric flow rate of premixed oxidant is about 2-10% of the total main oxidant flow rate. In one particular conduit, the volumetric flow rate of any fluid is divided amongst different outlet by correlating individual exit cross-section area with the total exit cross-sectional area for that conduit. In doing so, the pressure of the fluid and pressure differential between two adjacent conduits are important criteria to determine the directional flow of fluid. For example, FIG. 6B shows a sample area notation for oxidizer conduit. The cross-sectional area of bleed holes (28), air purge holes (32), swirler section outlet (34), and premixing holes (27) is A0, A1, A2, and A3.

$$A0=5 \text{ to } 25\% \text{ of } (A0+A1+A2+A3)$$

$$A3=2 \text{ to } 10\% \text{ of } (A0+A1+A2+A3)$$

Accordingly, in preferred embodiments herein, the cross-sectional area of bleed holes (28), air purge holes (32), swirler section outlet (34), and premixing holes (27) is A0, A1, A2, and A3, wherein A0=5 to 25% of (A0+A1+A2+A3).

Likewise, in preferred embodiments herein, the cross-sectional area of bleed holes (28), air purge holes (32), swirler section outlet (34), and premixing holes (27) is A0, A1, A2, and A3, wherein A3=2 to 10% of (A0+A1+A2+A3).

Preferably herein, the secondary fuel conduit (40) is in proximity with the main oxidant conduit (30) wherein D5/D4 is preferably between 1.05 and 1.40 and more preferably D5/D4 is between 1.1 and 1.25. This allows to start the flow of secondary fuel and ignition by heat from the primary fuel flame (acts as a pilot flame for the secondary fuel) without the need for furnace being above autoignition temperature of the secondary fuel and/or need of a ignition source to ignite the secondary fuel.

Figure 6A:
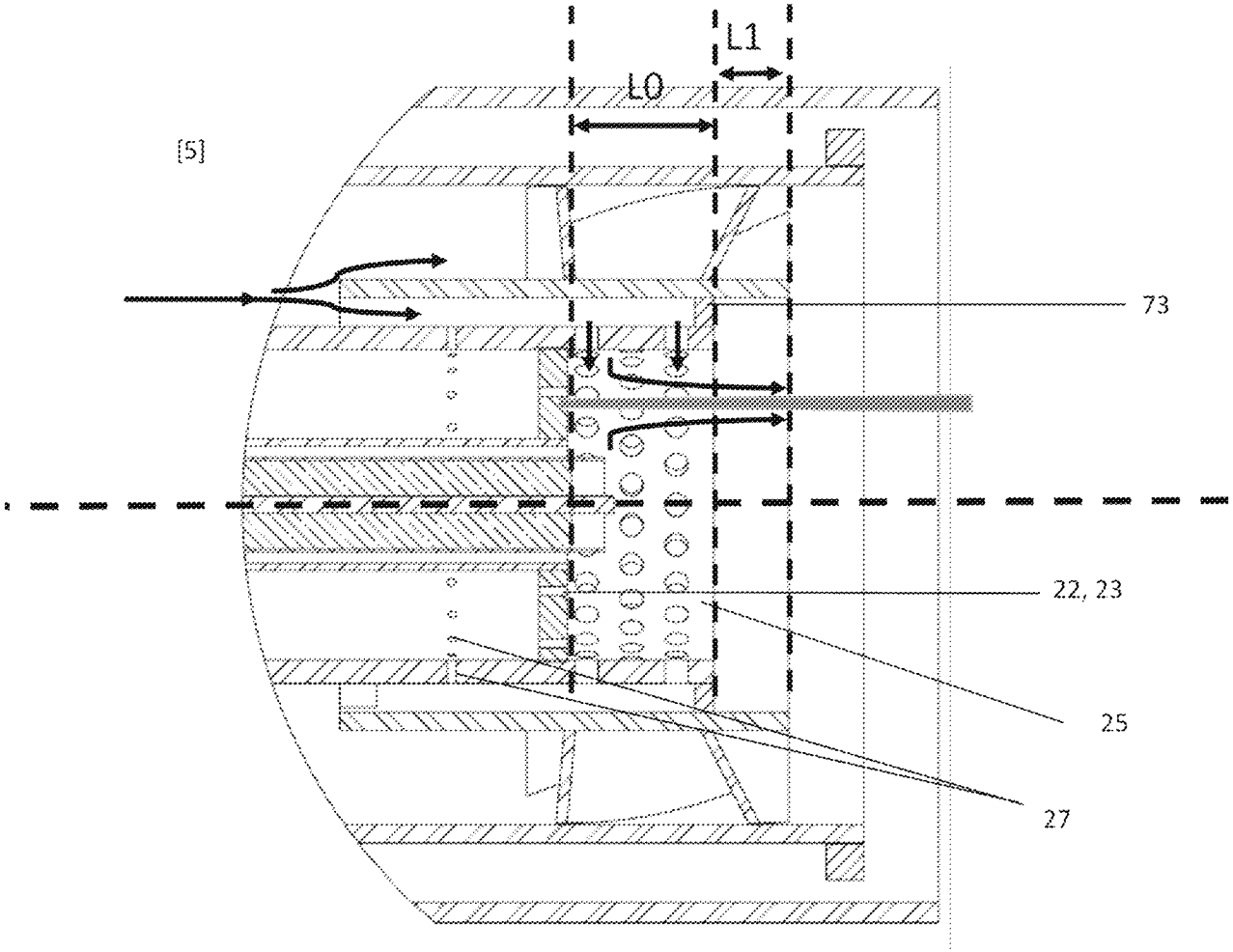
FIG. 6*a* is an exemplary side cross-sectional view of a downstream portion of a burner of the present invention e.g. emphasizing flow and interaction of primary fuel and main oxidant.
Figure 6B:
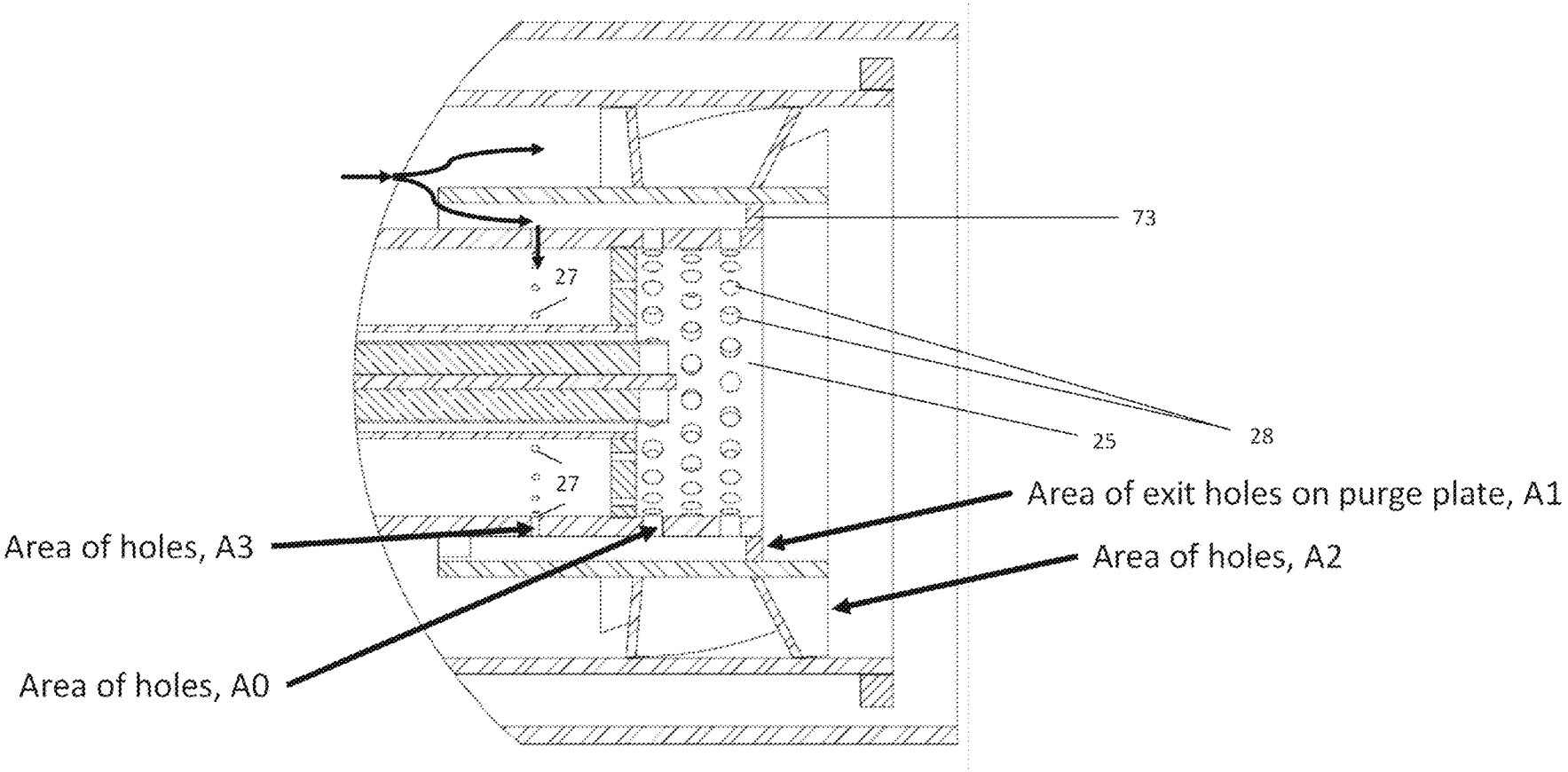
FIG. 6*b* is a corresponding view of an embodiment including partial premixing of the above as an optional feature. The air premixing holes divert a small fraction of the primary air to the primary fuel pipe.

Further particular embodiments of the invention are described in the present Figures, which may be described in further detail as follows:

As is e.g. also indicated in FIG. 6*a*, a portion of primary air (typically 2%-40%, preferably 10% to 25%, such as around 20% of the total) is introduced into the ignition chamber enters via the peripheral wall of the chamber, which is at right angles to the fuel distribution nozzle. This serves to vigorously mix the fuel and "ignition" air to enable ignition to reliably and repeatably occur with a gas mixture in the flammable range of fuel concentration, while also enabling peak flame temperatures to be reduced compared with typical diffusion flames. This is regarded important for minimization of flame-generated NOx emissions. Moreover, the method of air introduction also keeps the peripheral wall cooled by protecting it from direct contact with the flame. The fuel distribution plate (72) (which term may be exchangeably used herein with "primary fuel exit plate") is recessed by L0+L1 length in order to give more length for the fuel jets to partially or fully develop and partially-premix with the "ignition cup" air.

As is e.g. also indicated in FIG. 6*b* the air premixing holes (27) enable fluid communication between primary air and primary fuel upstream of the fuel distribution plate (72). These holes (numbers and diameter, rows of holes) may be predetermined based on the area ratio of the holes A3 and swirl air exit area, as well as the pressures of air and primary fuel. The pre-calculated ratio is dependent on the amount of air needed in the primary fuel during startup.

Generally herein, advantageous characteristics of the present invention include the following, all of which correspond to other preferred embodiments of the first aspect:

- The burner of the first aspect may be characterized in that provides improved mixing of main oxidant and primary fuel.
- The burner of the first aspect may be characterized in that provides improved partial pre-mixing of main oxidant and primary fuel.
- The burner of the first aspect may be characterized in that it is characterized by a reduced flame length.
- The burner of the first aspect may be characterized in that it is fuel-flexible (and e.g. allows use of NG, H2, LPG with a low Btu secondary fuel). It allows reliable start-up in a cold furnace (below auto-ignition temperature of the fuel) using air-fuel mode.
- The burner of the first aspect may be characterized in that no water cooling is required.
- The burner of the first aspect may be characterized in that it allows keeping low NOx, e.g. keeping NOx within environmental limits.
- The burner of the first aspect may be characterized in that it can operate with air-fuel mode irrespective of the average temperature of a furnace.
- The burner of the first aspect may be characterized by a turndown ratio of 1:30.
- The burner of the first aspect may be characterized by a fuel lean stable flame without flame blow-off at high excess air (equivalence ratio of as low as 0.25), in primary fuel mode the burner continues to operate when the primary fuel is reduced to 10% of maximum firing rating of the burner and secondary fuel is cut-off
- The burner of the first aspect may be characterized in that it enables stable and reliable ignition and combustion under cold furnace conditions with equivalence ratio as low as 0.25.
- The burner of the first aspect may be characterized in flexibility in burner operation across wide range of split of total heat/energy coming from primary vs secondary fuel. This includes about 5% to 100% total thermal output coming from primary fuel and balance from the secondary fuel.
- The burner of the first aspect may be characterized in production of a compact flame (Flame Length/D3<20) (see FIG. 8).

In a second aspect of the invention, there is provided a furnace comprising a burner according to the first aspect of the invention.

Preferred embodiments of the furnaces of the invention correspond to the embodiments of the burners of the invention described above. Hence, preferably, the furnace is further defined in line with any of the above embodiments of the burner as described in context with the first aspect.

This includes embodiments relating to the above described advantages of the burner of the first aspect, which are also envisaged herein regarding respective furnaces of the second aspect.

In certain preferred embodiments, the furnace is selected from the group consisting of a furnace for steam methane reforming, a reheat furnace in steel industries, and a secondary melting furnace.

In a third aspect of the invention, there is provided a method for operating a burner of the first aspect and/or for operating a furnace of the second aspect.

Said method is not particularly limited as will readily be appreciated by the skilled person.

In certain embodiments, the method comprises the steps of i) starting the burner, ii) ramping up the burner in firing rate, iii) starting the secondary fuel, iv) further changing the flow rate of primary, secondary fuel and burner equivalence ratio as required by the process.

In particular embodiments of the third aspect, step i) comprises starting the main oxidant, the igniter, and the primary fuel.

Generally, further preferred embodiments of the methods of the invention correspond to the embodiments of the burners of the invention described above, wherein the burner used in the method is further defined by further product features. In other words, preferably, the methods of the invention are further defined in line with any of the above embodiments of the burner as described in context with the first aspect.

Moreover, even further preferred embodiments of the methods of the invention involve further method features that are based on any features described above in context with the burners of the invention.

Moreover, advantages of the present invention include the following, all of which correspond to further preferred embodiments of the third aspect:

The method of the third aspect may be characterized in that provides improved mixing of main oxidant and primary fuel.

The method of the third aspect may be characterized in that provides improved partial pre-mixing of main oxidant and primary fuel.

The method of the third aspect may be characterized in that it is characterized by a reduced flame length.

The method of the third aspect may be characterized in that it is fuel-flexible (and e.g. allows use of NG). It allows reliable start-up in a cold furnace (below auto-ignition temperature of the fuel) using air-fuel mode.

The method of the third aspect may be characterized in that no water cooling is required.

The method of the third aspect may be characterized in that it allows keeping low NOx, e.g. keeping NOx within environmental limits.

The method of the third aspect may be characterized in that a low back pressure of combustion air eliminates the need of any secondary compression device.

The method of the third aspect may be characterized in that it can operate with air-fuel mode irrespective of the average temperature of a furnace.

Moreover, generally herein, preferred embodiments of any of the second to fourth aspects correspond to preferred embodiments of the first aspect herein.

In general, the articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

Moreover, generally herein, if a certain embodiment is described by using the term "comprising" or suchlike terms, further embodiments are envisaged herein as well, which are described by using the term "consisting of" or suchlike terms instead of the said term "comprising" or suchlike terms.

FURTHER PARTICULAR EMBODIMENTS

The present invention particularly also relates to the following items:

Item 1: A burner (1), comprising an ignition source (10), a primary fuel conduit (20) comprising a primary fuel outlet (22) having a multiplicity of primary fuel exit holes (23) for supply of a primary fuel into an ignition chamber (25), wherein the wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, a secondary fuel conduit (40) for supply of a secondary fuel, having a secondary fuel outlet (44) at its downstream end, Item 2: The burner of item 1, wherein at least in the downstream portion (5) of the burner (1), in which primary fuel outlet (22), ignition chamber (25), intermediate annular conduit (35) and secondary fuel outlet (44) are present, the primary fuel conduit (20) is surrounded by the main oxidant conduit (30) and the secondary fuel conduit (40).

Item 3: The burner of item 1 or 2, wherein the ignition chamber (25) is positioned within the primary fuel conduit (20), and is extending from the primary fuel outlet (22) to the primary fuel conduit end plane (24), wherein the primary fuel conduit wall (29) is surrounding the ignition chamber (25) and comprises a plurality of bleed holes (28).

Figure 7A:
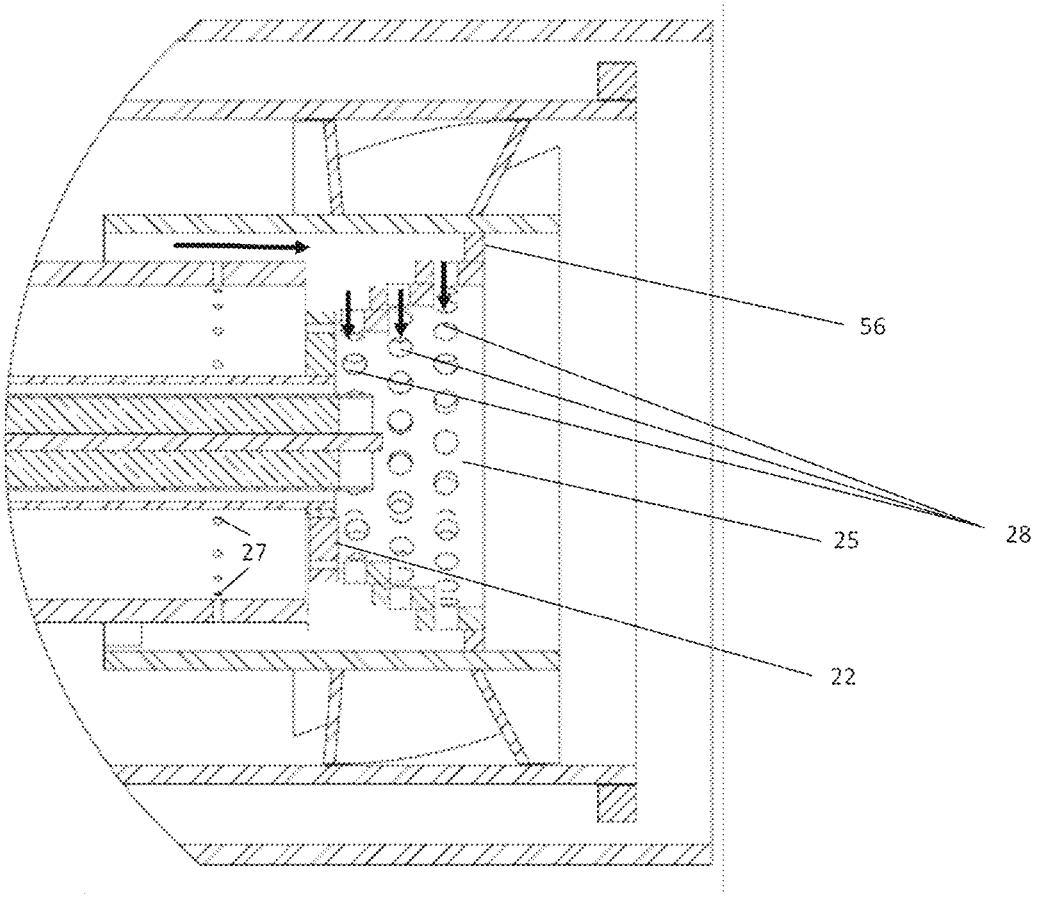
FIGS. 7*a-c* are exemplary cross-sectional views of alternative embodiments of the present invention involving alternative types of (partial) premixing of primary fuel and main oxidant (e.g. air), such as using "step design".

Item 4 (cf. e.g. FIG. 7A): The burner of item 1 or 2, wherein the ignition chamber (25) is extending from the primary fuel outlet (22) to the intermediate annular conduit exit plane (56), wherein the wall surrounding the ignition chamber (25) comprises at least two (preferably two or three) steps of annular conduits with increasing diameter, each of which comprises a plurality of bleed holes (28).

Figure 7B:
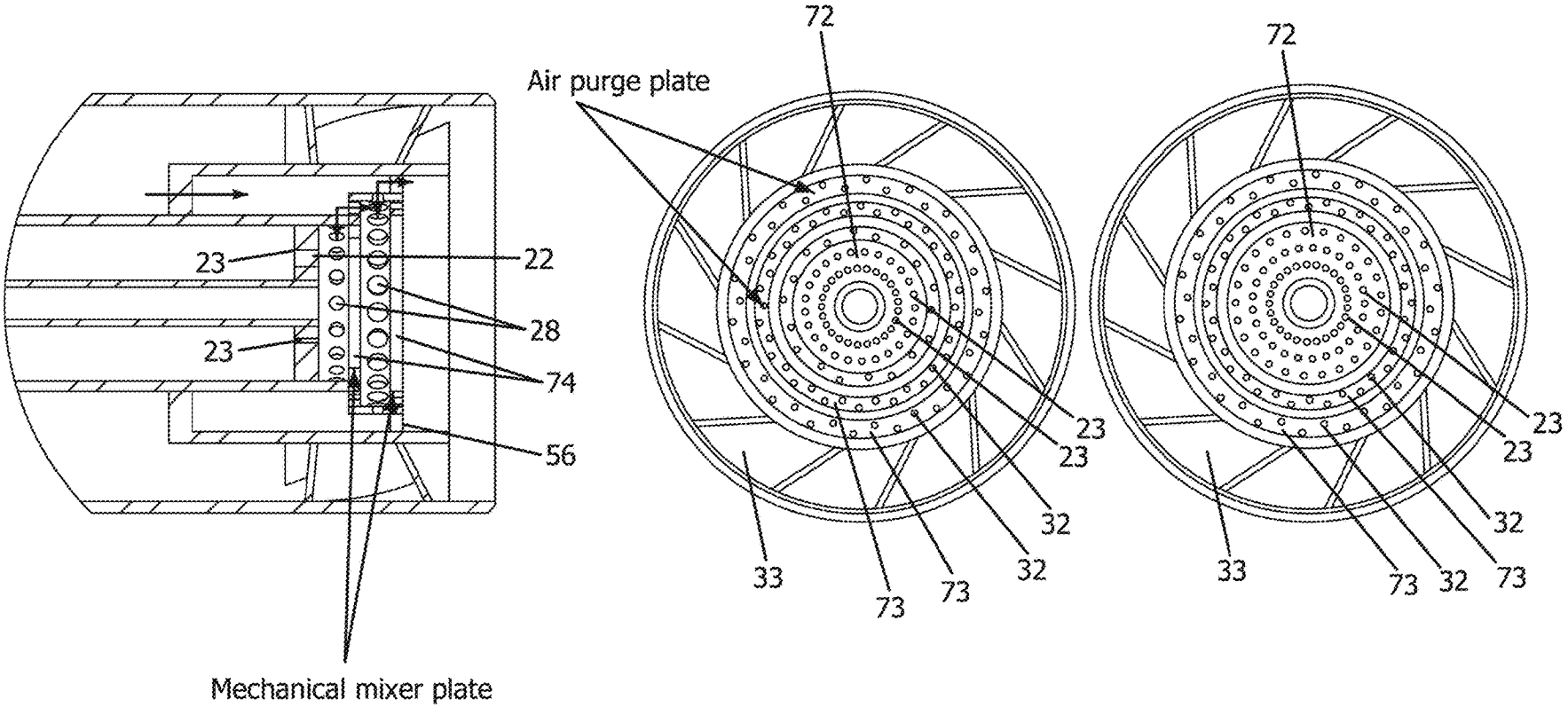

Item 5 (see e,g, FIG. 7B): The burner of item 1 or 2, wherein the ignition chamber (25) is extending from the primary fuel outlet (22) to the intermediate annular conduit exit plane (56), wherein the wall surrounding the ignition chamber (25) comprises two sections, wherein i) the first section is extending from the primary fuel outlet (22) to the primary fuel conduit end plane (24), wherein the primary fuel conduit wall (29) surrounding the section comprises a plurality of bleed holes (28), and ii) the second section has an inner diameter greater than the outer diameter of the primary fuel conduit (20), but the second section has an outer diameter smaller than the inner diameter of the intermediate annular conduit (35), and comprises a further plurality of bleed holes (28), optionally wherein the burner further comprises iii) an air purge plate (73) with purge holes (32) that extends between the first section's outer diameter and the inner diameter of the second section, and iv) two mechanical mixer plates (74) each located downstream of and adjacent to the said two sections.

Figure 7C:
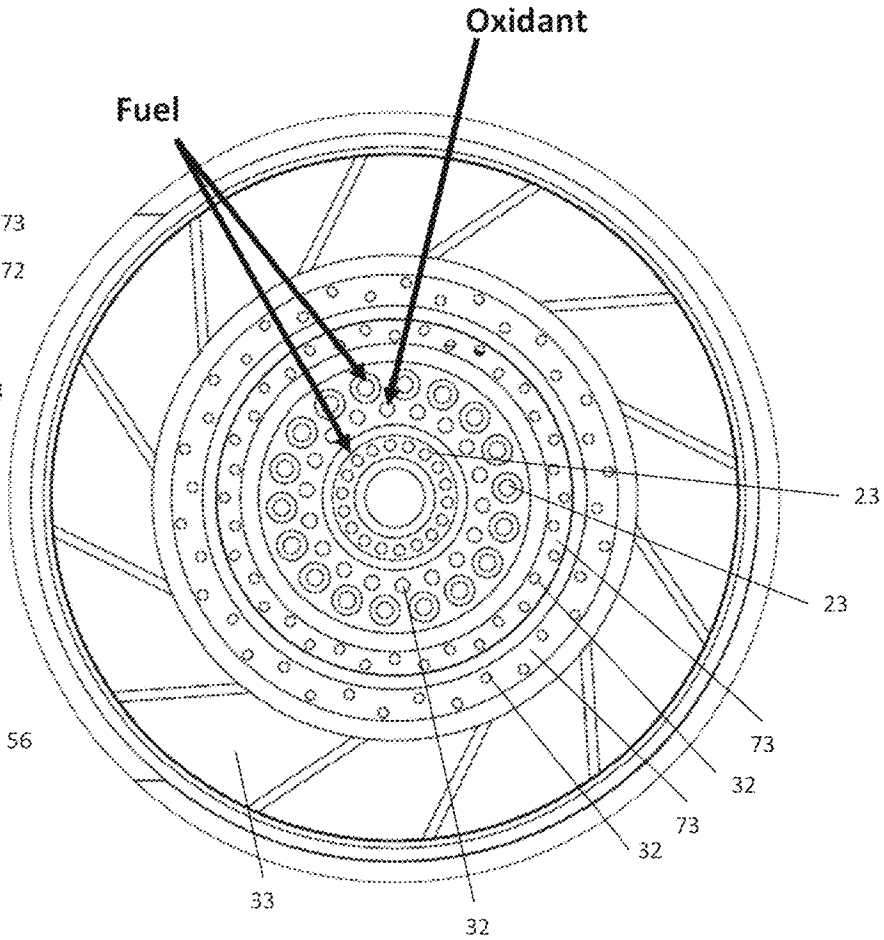
Figure 7C:
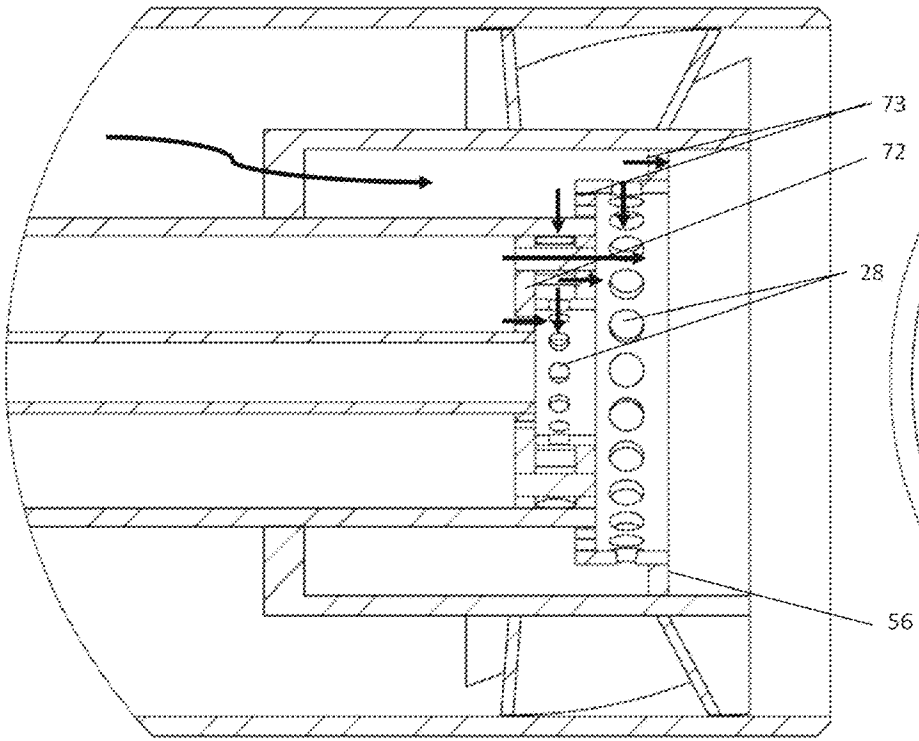

Item 6 (cf. e.g. FIG. 7C): The burner of item 1 or 2, wherein the ignition chamber (25) is extending from the primary fuel outlet (22) to the intermediate annular conduit exit plane (56), wherein the wall surrounding the ignition chamber (25) comprises two sections, wherein i) the first section has an outer diameter smaller than the inner diameter of the primary fuel conduit (20) and comprises a plurality of bleed holes (28), wherein the primary fuel conduit wall (29) surrounding the first section comprises a plurality of bleed holes (28), and wherein the first section further comprises means allowing the main oxidant to additionally enter the ignition chamber (25) in flow direction in between two rings of primary fuel exit holes, and ii) the second section has an inner diameter greater than the outer diameter of the primary fuel conduit (20), but the second section has an outer diameter smaller than the inner diameter of the intermediate annular conduit (35), and comprises a further plurality of bleed holes (28).

Item 7: The burner of any one of the preceding items, wherein the ignition source (10) terminates in the ignition chamber (25), particularly wherein the ignition source (10) is a central ignition source having a central axis (15) and a conduit end plane (16), especially wherein the main axis (2) of the burner (1) coincides with the central axis (15) of the ignition source (10), in particular wherein at least in said downstream portion (5) of the burner (1) the central ignition source (10) is surrounded by the primary fuel conduit (20), the main oxidant conduit (30) and the secondary fuel conduit (40).

Item 8: The burner of any one of the preceding items, i) the primary fuel conduit end plane (24) corresponds to the ignition chamber end plane (26); and/or ii) the primary fuel conduit further comprises air premixing holes (27) upstream of the primary fuel outlet (22); and/or iii) the main oxidant conduit (30) further comprises purge holes (32) in flow direction parallel to the main axis (2) of the burner; and/or iv) the main oxidant conduit (30) further comprises a swirler section (33), particularly wherein the intermediate annular conduit (35) is configured to allow splitting of the main oxidant into two portions, wherein a second portion is introduced into a swirler section (33); and/or v) the burner (1) further comprises a turbulence generator (47) in the secondary fuel conduit (40).

Item 9: The burner of any one of the preceding items, wherein the main oxidant conduit (30) further comprises a swirler section (33), particularly wherein the intermediate annular conduit (35) is configured to allow splitting of the main oxidant into two portions, wherein a second portion is introduced into a swirler section (33).

Item 10: The burner of any one of the preceding items, wherein the burner (1) further comprises a turbulence generator (47) in the secondary fuel conduit (40).

Item 11: The burner of any one of the preceding items, wherein the primary fuel conduit end plane (24) corresponds to the ignition chamber end plane (26).

Item 12: The burner of any one of the preceding items, wherein the primary fuel conduit further comprises air premixing holes (27) upstream of the primary fuel outlet (22).

Item 13: The burner of any one of the preceding items, wherein the main oxidant conduit (30) further comprises purge holes (32) in flow direction parallel to the main axis (2) of the burner.

Item 14: The burner of any one of the preceding items, wherein the main oxidant conduit (30) further comprises a swirler section (33), particularly wherein the intermediate annular conduit (35) is configured to allow splitting of the main oxidant into two portions, wherein a second portion is introduced into a swirler section (33).

Item 15: The burner of any one of the preceding items, wherein the burner (1) further comprises a turbulence generator (47) in the secondary fuel conduit (40), particularly wherein said turbulence generator comprises one or more turbulence generator disc(s).

Item 16: The burner of any one of the preceding items, wherein i) the diameter of the primary fuel exit holes (23) is defined as D0, wherein D0/D2 is between 0.04 and 1.00; and/or ii) the diameter of the purge holes (32) is defined as D1, wherein D1/D2 is between 0.04 and 0.5; and/or iii) the outer diameter of the ignition source (10) is defined as D2 and the inner diameter of the primary fuel conduit (20) is defined as D3, wherein D3/D2 is from 1.5 to 4.5, in particular from 2.0 to 3.0; and/or iv) the outer diameter of the ignition source (10) is defined as D2 and the inner diameter of the main oxidant conduit (30) is defined as D4, wherein D4/D2 is from 3.0 to 9.0, in particular from 3.5 to 5.5; and/or v) the outer diameter of the ignition source (10) is defined as D2 and the inner diameter of the secondary fuel conduit (40) is defined as D5, wherein D5/D2 is from 5.0 to 11.0, in particular from 5.5 to 7.0; and/or vi) the diameter of the air premixing holes (27) is defined as P0, wherein P0/D2 is between 0.02 and 0.2, particularly between 0.05 and 0.2; and/or vii) the inner diameter of the bleed holes (28) is defined as P1; wherein P1/D2 is between 0.05 and 0.4; and/or iiix) the distance between the primary fuel conduit end plane (24) and the intermediate annular conduit end plane (36) is defined as L1 and the distance between the primary fuel conduit wall (29) and the intermediate annular conduit wall (37) is defined as L4, wherein L1/L4 is from 0.5 to 2.5, in particular from 1.0 to 2.0; and/or ix) the distance between the primary fuel conduit end plane (24) and the intermediate annular conduit end plane (36) is defined as L1, the distance between the intermediate annular conduit end plane (36) and the main oxidant conduit end plane (38) is defined as L2 and the inner diameter of the primary fuel conduit (20) is defined as D3, wherein (L1+L2)/D3 is from 0.25 to 1.0, in particular from 0.4 to 0.6; and/or x) the distance between the main oxidant conduit end plane (38) and the secondary fuel conduit end plane (46) is defined as L3, and the inner diameter of the main oxidant conduit (30) is defined as D4, wherein L3/D4 is from 0.05 to 0.25, in particular from 0.1 to 0.2; and/or xi) wherein the distance between the primary fuel outlet (22) and the primary fuel conduit end plane (24) and/or ignition chamber end plane (26) is defined as L0 and the inner diameter of the primary fuel conduit (20) is defined as D3, wherein L0/D3 is from 0.25 to 1.0, in particular from 0.4 to 0.6; and/or xii) the distance between two rows of bleed holes (28) measured between their centers is defined as H and the inner diameter of the bleed holes (28) is defined as P1, wherein H/P1 is from 1.25 to 2.5; and/or xiii) the angle defined by the main axis (2) of the burner and the centers of two adjacent bleed holes (28) is defined as angle alpha, wherein angle alpha is from 3 to 30 degrees; and/or xiv) the angle defined by the main axis (2) of the burner and the centers of two adjacent purge holes (32) is defined as angle beta, wherein angle beta is from 5 to 40 degrees; and/or xv) the angle defined by the main axis (2) of the burner and the centers of two adjacent primary fuel exit holes (23) is defined as angle theta, wherein angle theta is from 10 to 40 degrees.

Item 17: The burner of any one of the preceding items, wherein the diameter of the primary fuel exit holes (23) is defined as D0, wherein D0/D2 is between 0.04 and 0.5.

Item 18: The burner of any one of the preceding items, wherein the diameter of the purge holes (32) is defined as D1, wherein D1/D2 is between 0.04 and 0.50.

Item 19: The burner of any one of the preceding items, wherein the outer diameter of the ignition source (10) is defined as D2, and the inner diameter of the primary fuel conduit (20) is defined as D3, wherein D3/D2 is from 1.5 to 4.5, in particular from 2.0 to 3.0.

Item 20: The burner of any one of the preceding items, wherein the outer diameter of the ignition source (10) is defined as D2, and the inner diameter of the main oxidant conduit (30) is defined as D4, wherein D4/D2 is from 3.0 to 9.0, in particular from 3.5 to 5.5.

Item 21: The burner of any one of the preceding items, wherein the outer diameter of the ignition source (10) is defined as D2, and the inner diameter of the secondary fuel conduit (40) is defined as D5, wherein D5/D2 is from 5.0 to 11.0, in particular from 5.5 to 7.0.

Item 22: The burner of any one of the preceding items, wherein the diameter of the air premixing holes (27) is defined as P0, wherein P0/D2 is between 0.02 and 0.2.

Item 23: The burner of any one of the preceding items, wherein the inner diameter of the bleed holes (28) is defined as P1, wherein P1/D2 is between 0.05 and 0.4

Item 24: The burner of any one of the preceding items, wherein the distance between the primary fuel conduit end plane (24) and the intermediate annular conduit end plane (36) is defined as L1, and the distance between the primary fuel conduit wall (29) and the intermediate annular conduit wall (37) is defined as L4, wherein L1/L4 is from 0.5 to 2.5, in particular from 1.0 to 2.0.

Item 25: The burner of any one of the preceding items, wherein the distance between the primary fuel conduit end plane (24) and the intermediate annular conduit end plane (36) is defined as L1, the distance between the intermediate annular conduit end plane (36) and the main oxidant conduit end plane (38) is defined as L2, and the inner diameter of the primary fuel conduit (20) is defined as D3, wherein (L1+L2)/D3 is from 0.25 to 1.0, in particular from 0.4 to 0.6.

Item 26: The burner of any one of the preceding items, wherein the distance between the main oxidant conduit end plane (38), and the secondary fuel conduit end plane (46) is defined as L3, and the inner diameter of the main oxidant conduit (30) is defined as D4, wherein L3/D4 is from 0.05 to 0.25, in particular from 0.1 to 0.2.

Item 27: The burner of any one of the preceding items, wherein the distance between the primary fuel outlet (22), and the primary fuel conduit end plane (24) and/or ignition chamber end plane (26) is defined as L0 and the inner diameter of the primary fuel conduit (20) is defined as D3, wherein L0/D3 is from 0.25 to 1.0, in particular from 0.4 to 0.6.

Item 28: The burner of any one of the preceding items, wherein the distance between two rows of bleed holes (28) measured between their centers is defined as H and the inner diameter of the bleed holes (28) is defined as P1, wherein H/P1 is from 1.25 to 2.5.

Item 29: The burner of any one of the preceding items, wherein the angle defined by the main axis (2) of the burner and the centers of two adjacent bleed holes (28) is defined as angle alpha, wherein angle alpha is from 3 to 30 degrees.

Item 30: The burner of any one of the preceding items, wherein the angle defined by the main axis (2) of the burner and the centers of two adjacent purge holes (32) is defined as angle beta, wherein angle beta is from 5 to 40 degrees.

Item 31: The burner of any one of the preceding items, wherein the angle defined by the main axis (2) of the burner and the centers of two adjacent primary fuel exit holes (23) is defined as angle theta, wherein angle theta is from 10 to 40 degrees.

Item 32: The burner of any one of the preceding items 16 to 31, wherein i) D3/D2 is from 1.5 to 4.5, in particular from 2.0 to 3.0; and/or ii) D4/D2 is from 3.0 to 9.0, in particular from 3.5 to 5.5; and/or iii) D5/D2 is from 5.0 to 11.0, in particular from 5.5 to 7.0.

Item 33: The burner of any one of the preceding items 16 to 32, wherein i) L1/L4 is from 0.5 to 2.5, in particular from 1.0 to 2.0; and/or ii) L0/D3 is from 0.25 to 1.0, in particular from 0.4 to 0.6; and/or iii) (L1+L2)/D3 is from 0.25 to 1.0, in particular from 0.4 to 0.6; and/or iv) L3/D4 is from 0.05 to 0.25, in particular from 0.1 to 0.2; and/or v) H/P1 is from 1.25 to 2.5, and/or vi) D5/D4 is from 1.05 to 1.40, in particular from 1.1 to 1.25.

Item 34: The burner of any one of the preceding items 16 to 33, wherein i) angle alpha is from 3 to 30 degrees; and/or ii) angle beta is from 5 to 40 degrees; and/or iii) angle theta is from 10 to 40 degrees.

Item 35: The burner of any one of the preceding items, wherein the burner (1) is configured in such a way that—at the exit of a given conduit— i) the velocity of the primary fuel is between 30 ft/s and 500 ft/s, particularly between 40 ft/s and 400 ft/s; and/or ii) the velocity of the main oxidant is between 5 ft/s and 300 ft/s, particularly between 10 ft/s and 200 ft/s; and/or iii) the velocity of the secondary fuel is between 20 ft/s and 200 ft/s, particularly between 40 ft/s and 120 ft/s.

Item 36: The burner of any one of the preceding items, wherein the velocity of the primary fuel is between 30 ft/s and 500 ft/s, particularly between 40 ft/s and 400 ft/s.

Item 37: The burner of any one of the preceding items, wherein the velocity of the main oxidant is between 5 ft/s and 300 ft/s, particularly between 10 ft/s and 200 ft/s.

Item 38: The burner of any one of the preceding items, wherein the velocity of the secondary fuel is between 20 ft/s and 200 ft/s, particularly between 40 ft/s and 120 ft/s.

Item 39: The burner of any one of the preceding items, wherein the swirl angle is from 5 to 60 degrees.

Item 40: The burner of any one of the preceding items, wherein the swirl angle is from 30 to 45 degrees.

Item 41: The burner (1) of any one of the preceding items, wherein the central ignition source (10) forms "pipe 1" of the burner.

Item 42: The burner (1) of any one of the preceding items, wherein the primary fuel conduit (20) forms "pipe 2" of the burner.

Item 43: The burner (1) of any one of the preceding items, wherein the main oxidant conduit (30) forms "pipe 3" of the burner, which particularly is an air pipe.

Item 44: The burner (1) of any one of the preceding items, wherein the secondary fuel conduit (40) forms "pipe 4" of the burner.

Item 45: The burner (1) of any one of the preceding items, wherein all of the said conduits share a common central axis.

Item 46: The burner (1) of any one of the preceding items, wherein all of the said conduits are concentrically disposed around a common longitudinal axis at least in the said downstream portion (5).

Item 47: The burner (1) of any one of the preceding items, wherein all of the conduits are essentially straight.

Item 48: The burner (1) of any one of the preceding items, wherein the burner (1) comprises a configuration as essentially depicted in any of the attached Figures or any combination thereof.

Item 49: The burner of any one of the preceding items, wherein the ignition chamber (25) is characterized by at least two (preferably by two or three) steps in its wall, wherein each step comprises a rows of bleed holes (28).

Item 50: The burner of any one of the preceding items, wherein the ignition chamber (25) is extending from the primary fuel conduit exit plane (55) to the intermediate annular conduit exit plane (56).

Item 51: The burner of any one of the preceding items, wherein the ignition chamber (25) comprises a section having an outer diameter that is smaller than or equal the inner diameter of the primary fuel conduit (20).

Item 52: The burner of any one of the preceding items, wherein the ignition chamber (25) comprises a section having an inner diameter that is greater than the outer diameter of the primary fuel conduit (20), but having an outer diameter that is smaller than the inner diameter of the intermediate annular conduit (35).

Item 53: A method for operating a burner (1) in accordance with any one of items 1 to 52, the method comprising the steps of i) starting the burner,
ii) optionally ramping up the burner in firing rate,
iii) starting the secondary fuel,
iv) changing the fraction of total heat supplied by the primary fuel and the secondary fuel as desired by the process.

Item 54: A method for operating a burner (1) in accordance with any one of items 1 to 52, the method comprising the steps of i) starting the burner,
ii) optionally ramping up the burner in firing rate,
iii) starting the secondary fuel,
iv) further changing the flow rate of primary, secondary fuel and burner equivalence ratio as required by the process.

Item 55: The method of item 53 or 54, wherein step i) comprises starting the main oxidant, the igniter, and the primary fuel.

Item 56: The burner of any one of the preceding items 53-55, wherein the burner (1) is configured in such a way that i) during start-up, about 100% of the total thermal power of the burner is provided by the primary fuel; and/or
ii) during normal operation, about 5 to 70%, preferably 45 to 65% of the total thermal power of the burner is provided by the primary fuel, and the respective rest is provided by the secondary fuel.

Item 57: The burner of any one of the preceding items 53-56, wherein the burner (1) is configured in such a way that during start-up, about 100% of the total thermal power of the burner is provided by the primary fuel.

Item 58: The burner of any one of the preceding items 53-57, wherein the burner (1) is configured in such a way that during normal operation, about 5 to 70%, preferably 45 to 65% of the total thermal power of the burner is provided by the primary fuel.

Item 59: The burner of any one of items 57 to 58, wherein the respective rest is provided by the secondary fuel Item 60: The burner of any one of the preceding items 53-59, wherein the burner (1) is configured in such a way that i) the volumetric flow rate of the ignition chamber oxidant is about 5 to 25% of the total main oxidant flow rate; and/or
ii) the volumetric flow rate of premixed oxidant is about 2-10% of the total main oxidant flow rate.

Item 61: The burner of any one of the preceding items 53-60, wherein the burner (1) is configured in such a way that the volumetric flow rate of the ignition chamber oxidant is about 5 to 25% of the total main oxidant flow rate.

Item 62: The burner of any one of the preceding items 53-61, wherein the burner (1) is configured in such a way that the volumetric flow rate of premixed oxidant is about 2-10% of the total main oxidant flow rate.

Item 63: The burner of any one of the preceding items 63-62, wherein the burner (1) is configured in such a way that, during normal operation, the burner can be turned down from 100% design firing rate to about 1:30 turndown, depending on the operation requirements.

EXAMPLES

The following example is used to further illustrate aspects of the invention, but are by no means intended to be limiting in any way.

Example 1

An exemplary test burner with air as oxidant and natural gas as primary fuel (trim fuel) and a mixture of (H2, CO2, CH4) as a low BTU value tailgas fuel was designed, manufactured, and tested in a laboratory test furnace.

The burner was operated over a wide range of operating conditions (Start-up, full load at heat-up, 100% design firing rate with both fuel, and 50% turndown condition with both fuel). The average furnace wall temperature under these conditions was in the range 450 F (during start-up and single fuel operation)-1600 F (dual fuel operation).

Figure 8:
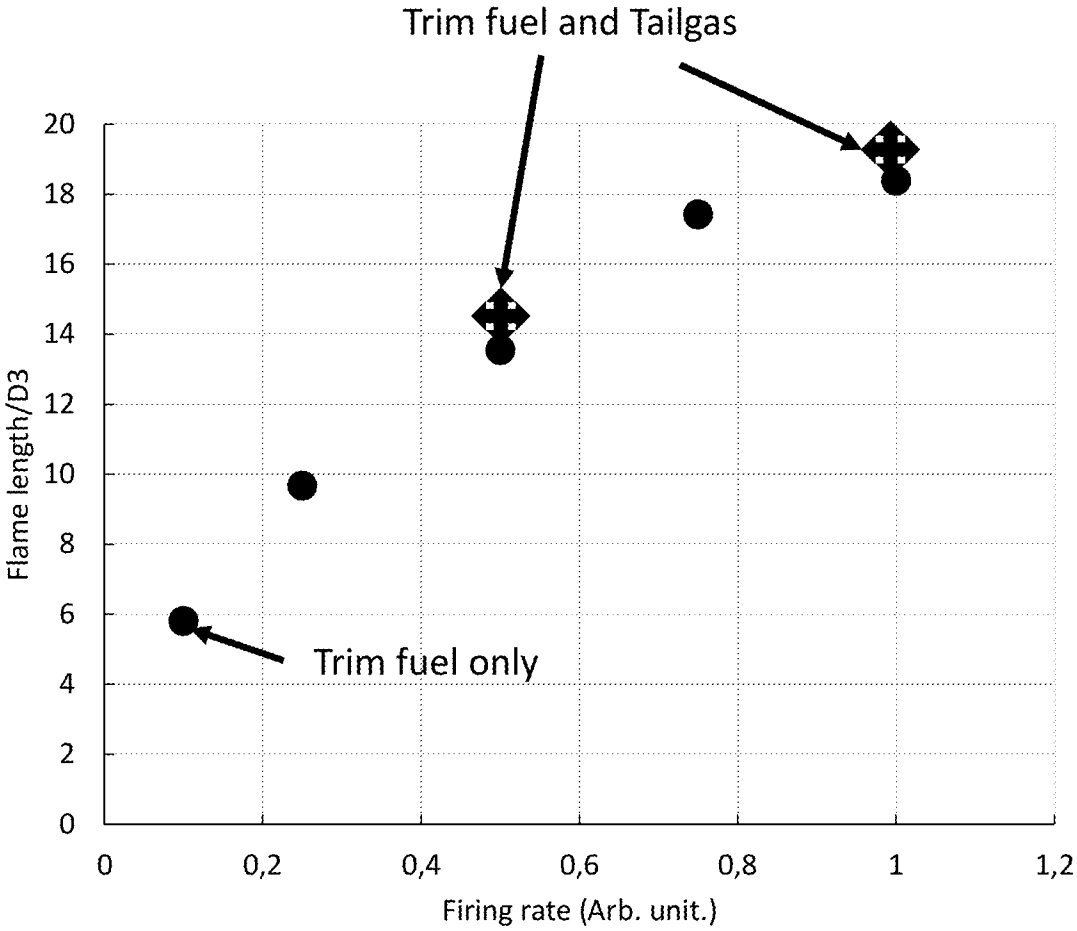
FIG. 8 shows experimental results obtained with an exemplary burner of the invention.

The plot in FIG. 8 of flame length vs burner firing rate shows that the flame length (L)/D3 is about 20.0 or less over a broad range of operating conditions This result is, moreover, unexpected given the low swirl number associated with the flow field exiting the burner nozzle. Swirl number, S, is defined as the ratio of the axial flux of angular momentum, $G_\phi$, to the product of the linear momentum, $G_x$, and the swirl vane outer radius, R4 (equal to 0.5×D4). That is:

$$S = \frac{G\phi}{R4 * Gx}$$

Calculation of the swirl number for the composite nozzle outlet flow field indicated a Swirl number of between about 0.2-0.3 for the operating conditions represented in FIG. 8. Swirl numbers in this range are categorized as weak and generally do not have a substantial effect on shortening of the flame relative to a non-swirled case. Prior art (see FIG. 6 from Hawthorne, W. R., D. S. Weddell, and H. C. Hottel. "Mixing and combustion in turbulent gas jets." *Symposium on Combustion and Flame, and Explosion Phenomena*. Vol. 3. No. 1. Elsevier, 1948) non-swirled burner flames typically exhibit non-dimensional flame lengths an order of magnitude larger than the data from FIG. 8. The fact that the present burner is able to produce a short flame under broad operating conditions with weak swirl is due to multiple unique features of this burner. First, the feature of injecting the primary fuel through multiple holes of jet diameter (D0)

helps the fuel to entrain the surrounding air in the fuel jets that enables the rate of fuel jet momentumtransport and combustion to take place closer to the burner as compared to prior art non-premixed burners. Moreover, these same multiple holes (D0) facilitate the creation of a momentum distribution comprising alternating peaks and valleys of high and low momenta, respectively across the exit plane of the ignition cup (i.e. at diameter, D3). Without wishing to be held to a theory, it is postulated that this non-uniform distribution of momentum renders the ignited primary fuel/ignition air mixture more susceptible to the axial momentum-disrupting effect of the primary air swirling flow. As such, even with a relatively low swirl number, the swirling flow acts in combination with the multiple holes (D0) to further reduce flame length. Second, the turbulence generator in the tailgas pipe helps to increase the turbulence intensity of the secondary fuel stream that enables to increase the rate of mixing of the secondary fuel with the air and hence, complete the combustion process for secondary fuel in short downstream distance. Third, the bleed holes (28) provide the oxidizer in the ignition cup that allows the fuel to entrain the air in the fuel jet before the burner exit plane. These unique design aspect of the burner along with the particular velocity range of the fluid streams help enhance oxidizer-fuel mixing thereby achieving complete combustion in short distances thought the swirl number is below 0.3. In absence of the above described design features of the burner, the design would have required use of very high swirl angle resulting in increased back pressure requirement, and leading to rapid heat-release that could damage the burner and/or create hot-spots, and still not enable the wide range of operational flexibility required by the burner as discussed in the text below.

Figure 9:
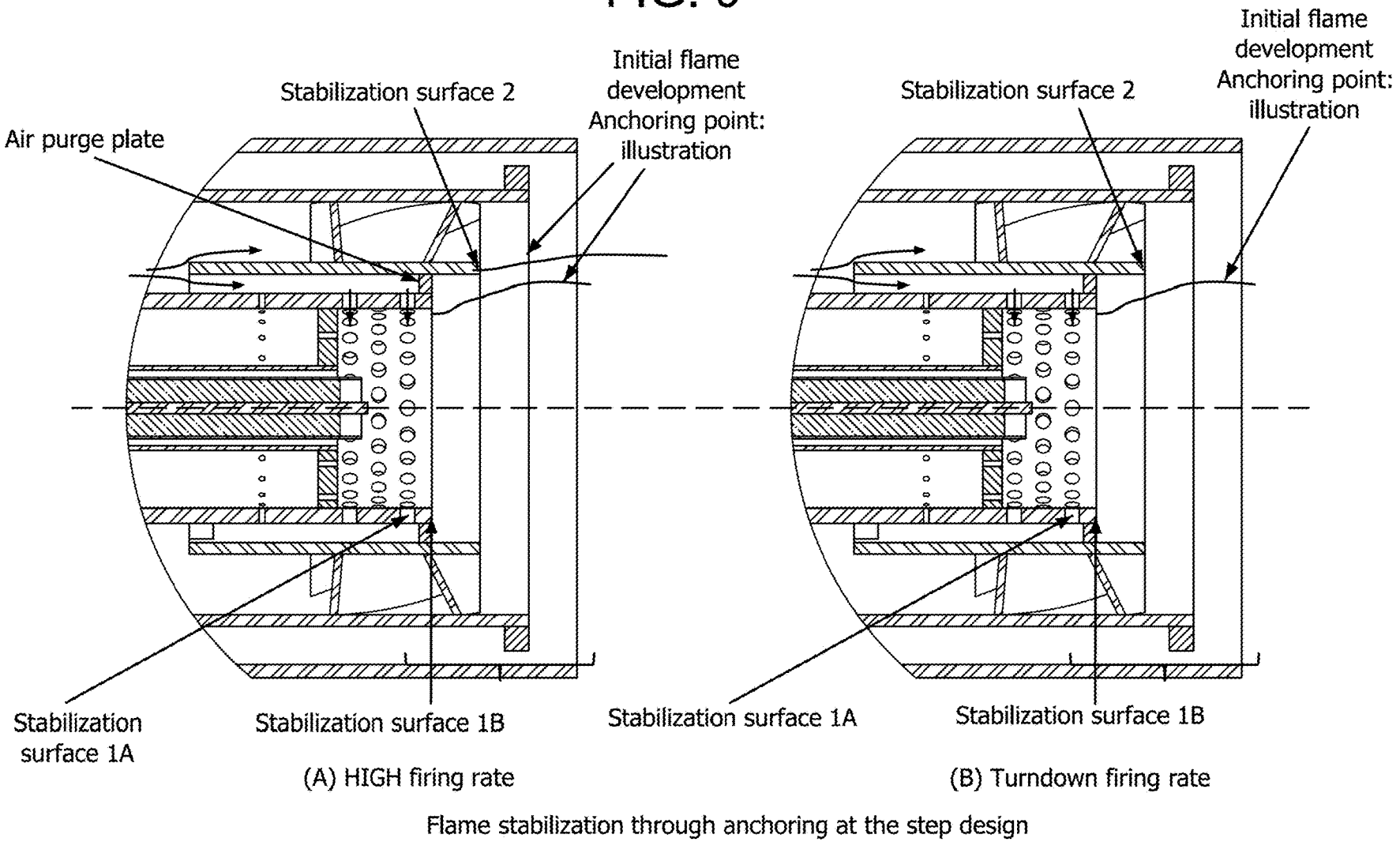
FIG. 9 illustrates and highlights jet development in context with an exemplary burner of the invention.

Additionally, the burner is able to produce stable flame at high turndown of 1:30 and at equivalence ratio of 0.25. This performance is because of the unique configuration of burner hardware that includes the location of air purge plate (73), step design aspect of it, and allowing the air to flow axially through the air purge plate (73) that provides a robust flame anchoring location. The burner provides multiple flame anchoring location based on the total firing rate of the burner as illustrated in FIG. 9. At high firing rate close to design firing rate of the burner, the flame is anchored at two locations: one near the air purge plate (73) and second on the periphery inside wall of the swirler exit plane. At low firing rate under turndown conditions and low equivalence ratio, the flame continues to anchor at the air purge plate (73) location without any blow-off because of recirculation zone setup in the area created by step design of the air purge plate (73). Furthermore, the air purge plate (73) is recessed by L1 from the swirler exit plane (34) that allows the flame anchoring to relatively be unaffected by the furnace atmosphere.

The burner is able to produce a stable flame for a wide range of split of primary and secondary fuels. The primary fuel can supply 5% to 100% of the total burner thermal output and remaining balance coming from the secondary fuel. The main reason for this flexible performance is the strong flame anchoring zone for primary fuel provided by the air purge plate (73) as discussed above that allows the primary fuel heat input to be reduced to as low as 5% of the total thermal output.

The design features of the burner allows oxidizer to be radially and axially purged in the ignition cup that keeps the peripheral wall cooled by protecting it from direct contact with the flame. The burner was operated in a plant setting reactor furnace and after one year of operation was found spotless without any damage to the burner hardware, in particular the ignition cup.

Furthermore, burner provides improved performance on NOx emissions. The bleed holes (28) provides air in the ignition cup that can be entrained by the fuel jets before the fuel leaves the exit plane of the burner. This enhanced mixing through a unique burner cup tip (ignition chamber) design thereby allows reducing peak temperatures relative to common characteristics of non-premixed burners. The lower peak temperature for this burner flame mimics that of a partially-premixed air-fuel combustion rather than non-premixed combustion.

Finally, the burner ignites well at equivalence ratios as low as 0.25, even at cold furnace conditions. This is possible because of the unique design of ignition cup that provides a zone where local ignition can be initiated and sustained while the composite fuel-air mixture is still below the global burner lower flammability limit of natural gas, which occurs at an equivalence ratio of approximately 0.48. Specifically, this is due to a portion of primary air being introduced into the ignition chamber, entering via the peripheral wall of the chamber, which is at right angles to the fuel distribution nozzle. This serves to vigorously mix the fuel and "ignition" air, creating numerous "pockets" of local fuel-air mixture having equivalence ratio within the flammable region, thereby enabling ignition to reliably and repeatably occur in spite of the composite gas mixture having a non-flammable fuel concentration.

The invention claimed is:

1. A burner (1), comprising a primary fuel conduit (20) comprising a primary fuel outlet (22) having a multiplicity of primary fuel exit holes (23) for supply of a primary fuel into an ignition chamber (25), wherein a wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, and a second portion is introduced into a swirler section (33), a secondary fuel conduit (40) for supply of a secondary fuel, having a secondary fuel outlet (44) at its downstream end, wherein at least in the downstream portion (5) of the burner (1), in which primary fuel outlet (22), ignition chamber (25), intermediate annular conduit (35) and secondary fuel outlet (44) are present, the primary fuel conduit (20) is surrounded by the main oxidant conduit (30) and the secondary fuel conduit (40);

wherein the ignition chamber (25) is positioned within the primary fuel conduit (20), and is extending from the primary fuel outlet (22) to the primary fuel conduit end plane (24), wherein the primary fuel conduit wall (29) is surrounding the ignition chamber (25) and comprises the plurality of bleed holes (28);

wherein the burner further comprises an ignition source (10), which terminates in the ignition chamber (25), wherein the main axis (2) of the burner (1) preferably coincides with the central axis (15) of the ignition source (10); and wherein the burner (1) further comprises a turbulence generator (47) in the secondary fuel conduit (40).

2. The burner of claim 1, wherein the ignition chamber (25) is positioned within the primary fuel conduit (20), and is extending from the primary fuel outlet (22) to the primary fuel conduit end plane (24), wherein the primary fuel conduit wall (29) is surrounding the ignition chamber (25) and comprises a plurality of bleed holes (28).

3. The burner of claim 2, wherein the ignition chamber (25) is extending from the primary fuel outlet (22) to the intermediate annular conduit exit plane (56), wherein the wall surrounding the ignition chamber (25) comprises two sections, wherein i) the first section is extending from the primary fuel outlet (22) to the primary fuel conduit end plane (24), wherein the primary fuel conduit wall (29) surrounding the section comprises a plurality of bleed holes (28), and ii) the second section has an inner diameter greater than the outer diameter of the primary fuel conduit (20), but the second section has an outer diameter smaller than the inner diameter of the intermediate annular conduit (35), and comprises a further plurality of bleed holes (28), and wherein iii) the burner optionally further comprises an air purge plate (73) with purge holes (32) that extends between the first section's outer diameter and the inner diameter of the second section, and iv) the burner optionally further comprises two mechanical mixer plates (74) each located downstream of and adjacent to the said two sections, and v) the burner optionally further comprises a purge plate (73) with purge holes (32) present between the outer diameter of the second section and inner diameter of the intermediate annular conduit (35).

4. The burner of claim 1, wherein the ignition chamber (25) is extending from the primary fuel outlet (22) to the intermediate annular conduit exit plane (56), wherein the wall surrounding the ignition chamber (25) comprises two sections, wherein i) the first section has an outer diameter smaller than the inner diameter of the primary fuel conduit (20) and comprises the plurality of bleed holes (28), wherein the primary fuel conduit wall (29) surrounding the first section comprises a plurality of bleed holes (28), and wherein the first section further comprises means allowing the main oxidant to additionally enter the ignition chamber (25) in flow direction in between two rings of primary fuel exit holes, ii) the second section has an inner diameter greater than the outer diameter of the primary fuel conduit (20), but the second section has an outer diameter smaller than the inner diameter of the intermediate annular conduit (35), and comprises a further plurality of bleed holes (28), and wherein iii) the burner optionally further comprises a purge plate (73) with purge holes (32) present between the first section's outer diameter and inner diameter of the second section, and iv) the burner optionally further comprises a purge plate (73) with purge holes (32) present between the outer diameter of the second section and inner diameter of the intermediate annular conduit (35).

5. The burner of claim 1, wherein the burner further comprises an ignition source (10) that terminates in the ignition chamber (25), particularly wherein the ignition source (10) is a central ignition source having a central axis (15) and a conduit end plane (16), especially wherein the main axis (2) of the burner (1) coincides with the central axis (15) of the ignition source (10), in particular wherein at least in said downstream portion (5) of the burner (1) the central ignition source (10) is surrounded by the primary fuel conduit (20), the main oxidant conduit (30) and the secondary fuel conduit (40).

6. The burner of claim 3, wherein i) the primary fuel conduit end plane (24) corresponds to the ignition chamber end plane (26); and/or ii) the primary fuel conduit further comprises air premixing holes (27) upstream of the primary fuel outlet (22); and/or iii) the main oxidant conduit (30) further comprises at least one air purge plate (73) that comprises purge holes (32) in flow direction parallel to the main axis (2) of the burner.

7. The burner of claim 3, wherein the main oxidant conduit (30) further comprises a swirler section (33), particularly wherein the intermediate annular conduit (35) is configured to allow splitting of the main oxidant into two portions, wherein a second portion is introduced into a swirler section (33)

especially wherein the swirl angle is from 5 to 60 degrees, preferably from 30 to 45 degrees.

8. The burner of claim 1, wherein the burner (1) further comprises a turbulence generator (47) in the secondary fuel conduit (40).

9. The burner of claim 3, wherein i) the diameter of the primary fuel exit holes (23) is defined as D0, wherein D0/D2 is between 0.04 and 0.5; and/or ii) the diameter of the purge holes (32) is defined as D1, wherein D1/D2 is between 0.04 and 0.5.

10. The burner of claim 1, wherein i) the outer diameter of the ignition source (10) is defined as D2 and the inner diameter of the primary fuel conduit (20) is defined as D3, wherein D3/D2 is from 1.5 to 4.5, in particular from 2.0 to 3.0; and/or ii) the outer diameter of the ignition source (10) is defined as D2 and the inner diameter of the main oxidant conduit (30) is defined as D4, wherein D4/D2 is from 3.0 to 9.0, in particular from 3.5 to 5.5; and/or iii) the outer diameter of the ignition source (10) is defined as D2 and the inner diameter of the secondary fuel conduit (40) is defined as D5, wherein D5/D2 is from 5.0 to 11.0, in particular from 5.5 to 7.0.

11. The burner of claim 6, wherein i) the diameter of the air premixing holes (27) is defined as P0, wherein P0/D2 is between 0.05 and 0.2; and/or ii) the inner diameter of the bleed holes (28) is defined as P1/D2; wherein P1/D2 is between 0.05 and 0.4; and/or iii) the distance between the primary fuel conduit end plane (24) and the intermediate annular conduit end plane (36) is defined as L1 and the distance between the primary fuel conduit wall (29) and the intermediate annular conduit wall (37) is defined as L4, wherein L1/L4 is from 0.5 to 2.5, in particular from 1.0 to 2.0; and/or iv) the distance between the primary fuel conduit end plane (24) and the intermediate annular conduit end plane (36) is defined as L1, the distance between the intermediate annular conduit end plane (36) and the main oxidant conduit end plane (38) is defined as L2 and the inner diameter of the primary fuel conduit (20)

is defined as D3, wherein (L1+L2)/D3 is from 0.25 to 1.0, in particular from 0.4 to 0.6; and/or v) the distance between the main oxidant conduit end plane (38) and the secondary fuel conduit end plane (46) is defined as L3, and the inner diameter of the main oxidant conduit (30) is defined as D4, wherein L3/D4 is from 0.05 to 0.25, in particular from 0.1 to 0.2; and/or vi) wherein the distance between the primary fuel outlet (22) and the primary fuel conduit end plane (24) and/or ignition chamber end plane (26) is defined as L0 and the inner diameter of the primary fuel conduit (20) is defined as D3, wherein L0/D3 is from 0.25 to 1.0, in particular from 0.4 to 0.6; and/or vii) the distance between two rows of bleed holes (28) measured between their centers is defined as H and the inner diameter of the bleed holes (28) is defined as P1, wherein H/P1 is from 1.25 to 2.5; and/or viii) the ratio of the area of all bleed holes in one row to the surface area of cylinder of height, P1 and inner diameter, D2 is between 10% and 55%; and/or ix) the air purge plate (73) has a porosity (defined by the total open area on the plate that allows the air to flow divided by cross-section area of the plate) in the range of 2% to 15%; and/or x) the primary fuel exit plate (72) has a porosity (defined by the total open area on the plate that allows the fuel to flow divided by cross-section area of the plate) in the range of 2% to 25%.

12. A burner (1), comprising a primary fuel conduit (20) comprising a primary fuel outlet (22) having a multiplicity of primary fuel exit holes (23) for supply of a primary fuel into an ignition chamber (25), wherein a wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, and a second portion is introduced into a swirler section (33), a secondary fuel conduit (40) for supply of a secondary fuel, having a secondary fuel outlet (44) at its downstream end, wherein at least in the downstream portion (5) of the burner (1), in which primary fuel outlet (22), ignition chamber (25), intermediate annular conduit (35) and secondary fuel outlet (44) are present, the primary fuel conduit (20) is surrounded by the main oxidant conduit (30) and the secondary fuel conduit (40), wherein the ignition chamber (25) is extending from the primary fuel outlet (22) to the intermediate annular conduit exit plane (56), wherein the wall surrounding the ignition chamber (25) comprises at least two (preferably two or three) steps of annular conduits with increasing radial extension, each of which comprises the plurality of bleed holes (28).

13. A burner (1), comprising a primary fuel conduit (20) comprising a primary fuel outlet (22) having a multiplicity of primary fuel exit holes (23) for supply of a primary fuel into an ignition chamber (25), wherein a wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, and a second portion is introduced into a swirler section (33), a secondary fuel conduit (40) for supply of a secondary fuel, having a secondary fuel outlet (44) at its downstream end, wherein at least in the downstream portion (5) of the burner (1), in which primary fuel outlet (22), ignition chamber (25), intermediate annular conduit (35) and secondary fuel outlet (44) are present, the primary fuel conduit (20) is surrounded by the main oxidant conduit (30) and the secondary fuel conduit (40), wherein the burner (1) is configured in such a way that i) the velocity of the primary fuel is between 30 ft/s and 500 ft/s, particularly between 40 ft/s and 400 ft/s; and/or ii) the velocity of the main oxidant is between 5 ft/s and 300 ft/s, particularly between 10 ft/s and 200 ft/s; and/or iii) the velocity of the secondary fuel is between 20 ft/s and 200 ft/s, particularly between 40 ft/s and 120 ft/s.

14. A burner (1), comprising a primary fuel conduit (20) comprising a primary fuel outlet (22) having a multiplicity of primary fuel exit holes (23) for supply of a primary fuel into an ignition chamber (25), wherein a wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, and a second portion is introduced into a swirler section (33), a secondary fuel conduit (40) for supply of a secondary fuel, having a secondary fuel outlet (44) at its downstream end, wherein at least in the downstream portion (5) of the burner (1), in which primary fuel outlet (22), ignition chamber (25), intermediate annular conduit (35) and secondary fuel outlet (44) are present, the primary fuel conduit (20) is surrounded by the main oxidant conduit (30) and the secondary fuel conduit (40), wherein the secondary fuel conduit (40) is in proximity with the main oxidant conduit (30), preferably wherein the inner diameter of the secondary fuel conduit (40) is defined as D5; the inner diameter of the main oxidant conduit (30) is defined as D4; and D5/D4 is between 1.05 and 1.40, more preferably between 1.1 and 1.25.

* * * * *